US009044362B2

(12) United States Patent
Gozelski, Jr. et al.

(10) Patent No.: US 9,044,362 B2
(45) Date of Patent: Jun. 2, 2015

(54) METHOD AND APPARATUS FOR PASSIVE EXERCISE TO FACILITATE BREATHING, PREVENT AND TREAT EDEMA AND POST SURGICAL ADHESIONS, AND IMPROVE THE DELIVERY OF INHALED MEDICATIONS

(75) Inventors: George Frank Gozelski, Jr., Cleveland, NC (US); Nicholas George Gozelski, Salisbury, NC (US); Robert Roy Redden, Southport, NC (US)

(73) Assignee: LBR Research, Inc., Cleveland, NC (US)

( * ) Notice: Subject to any disclaimer, the term of this patent is extended or adjusted under 35 U.S.C. 154(b) by 931 days.

(21) Appl. No.: 13/231,994

(22) Filed: Sep. 14, 2011

(65) Prior Publication Data

US 2012/0109027 A1 May 3, 2012

Related U.S. Application Data

(60) Provisional application No. 61/387,140, filed on Oct. 27, 2010.

(51) Int. Cl.

| | |
|---|---|
| ***A61G 7/005*** | (2006.01) |
| ***A61G 7/018*** | (2006.01) |
| ***A61H 1/00*** | (2006.01) |

(52) U.S. Cl.

CPC ..... *A61G 7/005* (2013.01); *A61H 2230/425* (2013.01); *A61G 7/018* (2013.01); *A61H 1/003* (2013.01); *A61H 2201/1238* (2013.01); *A61H 2201/1246* (2013.01); *A61H 2203/0456* (2013.01); *A61H 2230/405* (2013.01)

(58) Field of Classification Search

CPC ..... A61H 1/02; A61H 1/0222; A61H 1/0229; A61H 1/003; A61H 2230/425; A61H 2230/0456; A61H 2201/1238; A61H 2201/1246; A61H 2230/405; A61G 13/009; A61G 13/04; A61G 13/06; A61G 13/08; A61G 7/005; A61G 7/018

USPC ..... 601/24–26; 602/32; 606/237, 242; 472/106; 5/600, 607–608, 610

See application file for complete search history.

(56) References Cited

U.S. PATENT DOCUMENTS

| | | | | | |
|---|---|---|---|---|---|
| 2,104,745 | A | * | 1/1938 | Howell et al. | 601/90 |
| 2,696,207 | A | * | 12/1954 | Bushnell | 601/91 |
| 2,771,069 | A | * | 11/1956 | Baron | 601/42 |
| 3,060,925 | A | * | 10/1962 | Honsaker et al. | 601/24 |

(Continued)

*Primary Examiner* — Justine YU
*Assistant Examiner* — Timothy Stanis
(74) *Attorney, Agent, or Firm* — Carla Gannon Law

(57) ABSTRACT

The present invention embraces a method and an apparatus for preventing, treating or improving the efficacy of a variety of conditions and treatments including breathing difficulties, pitting peripheral edema, post-surgical adhesions, efficacy of CPAP/BiPAP and/or the delivery of inhaled medications. The method include raising and lowering the individual's head and feet in a series of steps and performing the steps of raising and lowering the individual's head and feet to substantially match a breathing cycle. The apparatus includes a platform for supporting the individual's body, a capital support mechanism for supporting and moving the platform, a capital drive mechanism, a pedestal support mechanism for supporting and moving the platform, and a pedestal drive mechanism. The method and the apparatus in operation typically move one or more axes of rotation while simultaneously rotating a platform about the one or more axes.

16 Claims, 11 Drawing Sheets

(56) References Cited

U.S. PATENT DOCUMENTS

| | | | | | |
|---|---|---|---|---|---|
| 3,247,528 | A * | 4/1966 | Swenson et al. | 5/658 |
| 4,277,857 | A * | 7/1981 | Svehaug | 5/610 |
| 4,769,584 | A * | 9/1988 | Irigoyen et al. | 318/648 |
| 4,847,929 | A * | 7/1989 | Pupovic | 5/608 |
| 5,320,641 | A * | 6/1994 | Riddle et al. | 606/243 |
| 5,720,059 | A * | 2/1998 | Allevato et al. | 5/610 |
| 6,659,935 | B2 * | 12/2003 | Costanzo | 600/22 |
| 6,817,363 | B2 * | 11/2004 | Biondo et al. | 128/845 |
| 2011/0132377 | A1 * | 6/2011 | Phillips | 128/845 |

* cited by examiner

METHOD AND APPARATUS FOR PASSIVE EXERCISE TO FACILITATE BREATHING, PREVENT AND TREAT EDEMA AND POST SURGICAL ADHESIONS, AND IMPROVE THE DELIVERY OF INHALED MEDICATIONS

REFERENCE TO RELATED APPLICATION

This application claims the priority benefit under 35 USC §119(e) from Provisional Application No. 61/387,140, filed Oct. 27, 2010.

BACKGROUND

The present invention relates to the fields of passive exercise and pulmonary therapy and, more specifically, to a method and apparatus for preventing, treating or improving the efficacy of a variety of conditions and treatments including breathing difficulties, pitting peripheral edema, post-surgical adhesions, efficacy of CPAP/BiPAP and/or the delivery of inhaled medications.

Shortness of breath and general breathing difficulties can be indicative of a variety of diseases and conditions suffered by individuals throughout the world including asthma, sleep apnea, emphysema, bronchitis, pneumonia, and chronic obstructive pulmonary disease (COPD). Breathing difficulties and breathing obstruction have also been linked to an increased risk of sudden infant death syndrome (SIDS).

Sleep apnea is a sleep disorder that includes abnormal pauses (e.g., a few seconds or minutes) in breathing or instances of abnormally low breathing. These pauses, or apneas, may occur between five and thirty times or more an hour. An abnormally low breathing event is called a hypopnea. Sleep apnea occurs in patients in one of three forms: central sleep apnea, obstructive sleep apnea, and complex or mixed sleep apnea. Individuals suffering from sleep apnea are typically unaware of their condition and experience daytime fatigue and sleepiness.

A variety of treatments have been developed for the treatment of sleep apnea. These treatments range from simply sleeping on one's side and avoiding alcohol or sleeping pills, jaw-shifting mouthpieces, and even surgery. One of the safest, most effective, and commonly prescribed treatments is the use of a continuous positive airway pressure (CPAP) device. A CPAP device includes a facial mask connected via a tube to a bedside machine. The machine generates air pressure to keep the patient's airways open during sleep. Typically, a sleep study is conducted by a medical professional or therapist to determine the appropriate settings for the CPAP machine. The patient is then given a prescription containing these settings. Although the CPAP device is safe and effective, many patients find it extremely uncomfortable and refuse to use the CPAP device.

As noted (above), COPD is another condition associated with shortness of breath and general breathing difficulties. There are two main forms of COPD, namely chronic bronchitis and chronic emphysema; however, most individuals with COPD have a combination of both forms. COPD is characterized by obstruction to airflow and typically is not fully reversible. The primary symptoms of the disease are a chronic cough, shortness of breath, chest tightness, increased mucus production, and frequent clearing of the throat. It is now the third leading cause of death in the United States accounting for approximately 4% of all deaths in the United States. Further, it is one of the fastest growing causes of death, second only to the AIDS virus. Death rates from COPD in recent decades increased more than 60%, whereas death rates for coronary heart disease, the current leading cause of death in the United States, decreased 30%. More than 12 million people in the US live with the diagnosis of COPD.

COPD typically develops slowly. Symptoms often worsen over time and can limit the ability to do routine activities. Severe COPD may prevent basic activities like walking, cooking, or self-care. Chronic obstructive pulmonary disease has become one of the most prevalent chronic diseases in America today. Over the next 20 years, medical costs related to COPD are expected to total approximately $832.9 billion in the United States.

A variety of treatments for COPD and other diseases and conditions associated with shortness of breath and breathing difficulties have been proposed. For example, medications such as bronchodilators and steroids have proven to be effective treatments. Bronchodilators widen the air passages of the lungs by relaxing bronchial smooth muscle, while steroids can reduce lung inflammation. For some patients, however, these medications alone are insufficient.

Oxygen therapy has also proven to be effective at reducing a patient's sensation of air hunger (dyspnea), and the declining cost and increasing mobility of oxygen-therapy systems has increased the popularity of this treatment. Nevertheless, oxygen therapy does not reduce the level of carbon dioxide in a patient's bloodstream because the volume of air exhaled by the patient is not increased. Thus, oxygen therapy alone is insufficient to treat all of the physiological effects of shortness of breath.

Cardiopulmonary rehabilitation programs have been used to treat diseases and conditions associated with shortness of breath. These programs typically include active exercise (e.g., walking on a treadmill) to increase lung function. Some patients, however, are simply incapable of active exercise because the mere act of breathing requires so much energy that physical exertion would jeopardize their ability to breath. Thus, active exercise may only be beneficial to some patients.

Accordingly, passive exercise treatments have been developed that stimulate deeper breathing but do not require physical exertion. One such treatment is positive pressure ventilation (PPV), which involves forcing air into the lungs, thereby increasing pressure in the airways relative the outside. U.S. Pat. No. 7,556,038 discloses a method of monitoring and controlling a patient's breathing rate using a PPV device. PPV has been used to treat shortness of breath and breathing difficulties, particularly during severe exacerbations and end-stage COPD. There are risks associated with PPV, however, and those risks increase as the pressure required to inflate the patient's lungs increases.

Another form of passive exercise treatment involves facilitating a patient's natural breathing by physically moving the patient's body. Typically, these passive exercise treatments involve placing the patient on a bed-like device that moves in a particular manner to facilitate breathing or encourage the movement of fluids within the patient, or both. For example, some passive exercise beds rock a patient from side-to-side in an oscillating motion. Other passive exercise beds "slide" the patient forward and backward, i.e., in the direction of the patient's feet and then in the direction of the patient's head.

Passive exercise has also proven to be beneficial to hospital patients confined to their beds due to recent surgery or immobility, as well as bed-ridden residents of nursing homes. For example, passive exercise can reduce the occurrence, frequency, or severity of bedsores. U.S. Pat. No. 4,999,861, which is hereby incorporated by reference in its entirety, discloses a bed constructed of independently movable segments that can be reciprocated down the length of a patient's body to passively exercise the patient and relieve the constant pressure that causes bedsores. Additionally, passive exercise may reduce the occurrence of blood clots by preventing blood from pooling in an immobile patient's legs or other areas of a patient's body. Furthermore, passive exercise can relieve or prevent adhesions that can occur after surgical procedures. Adhesions are bands of scar-like tissue that form between two surfaces in the body and can occur throughout the body. Passive exercise can be particularly effective at preventing abdominal adhesions.

Edema is excess fluid that is trapped in the body's tissues, and presents itself as swelling, often in the hands, arms, ankles, legs and feet. This condition is typically linked to problems with the venous or lymphatic system. This condition can be especially problematic when lymphostatic edema develops, which is the abnormal accumulation of protein in the lymph vessels, along with osmotically held fluids in the interstitial space. As toxins accumulate, cells are unable to function properly, thereby resulting in various metabolic and infectious problems. Passive exercise can be effective at preventing and treating edema.

Certain treatments for breathing conditions paradoxically rely on breathing function to be efficacious, for example Continuous Positive Air Pressure (CPAP), Bilevel Positive Air Pressure (BiPAP), Metered Dose Inhaler (MDI), Dry Powder Inhaler (DPI), and nebulizers. Passive exercise can be effective at improving peak breathing flow, and therefore facilitating improved medication delivery.

U.S. Pat. No. 6,817,363 discloses a variety of passive exercise treatments. One treatment includes tilting a patient from left to right about a fixed longitudinal axis extending parallel to an axis extending from the patient's head to the patient's feet. Another treatment includes rotating, or pivoting, the patient's body around a fixed axis that is perpendicular to the patient's height and is located near the patient's torso (i.e., a see-saw type motion). The pivoting motion raises the patient's head while lowering the patient's feet, and then lower's the patient's head while raising the patient's feet. The treatment methods and devices disclosed in U.S. Pat. No. 6,817,363 involve rotating the patient's body around a fixed pivot axis, which generates a sensation of rapid acceleration at the points of reversal. These sudden accelerations can cause significant patient discomfort, including nausea, particularly when the passive exercise treatment is performed for longer periods of time.

U.S. Patent Application Publication No. 2010/0063427 discloses a therapeutic system that includes an oscillatory, pivoting table for applying motion-induced therapeutic sensory stimuli to a user. The disclosed table, however, rotates the user's body around a fixed pivot axis and, therefore, also generates rapid accelerations and the associated discomfort.

Therefore, a need exists for a passive exercise method and device for the treatment of individuals suffering from breathing difficulties that reduces or eliminates sensations of rapid acceleration and provides a more comfortable treatment experience.

SUMMARY

Accordingly, in one aspect, the present invention embraces a method for preventing, treating or improving the efficacy of a variety of conditions and treatments including breathing difficulties, pitting peripheral edema, post-surgical adhesions, efficacy of CPAP/BiPAP and/or the delivery of inhaled medications. The method includes raising and lowering the individual's head and feet in a series of steps, monitoring the individual's breathing cycle, and performing the steps of raising and lowering the individual's head and feet to substantially match the individual's breathing cycle. The steps of the method include: (i) raising the individual's head without raising the individual's feet; (ii) thereafter simultaneously raising the individual's head and the individual's feet until the individual's head reaches a defined height T; (iii) thereafter raising the individual's feet until the individual's feet reach the defined height T; (iv) lowering the individual's head without lowering the individual's feet; (v) thereafter simultaneously lowering the individual's head and the individual's feet until the individual's head reaches a height B; and (vi) thereafter lowering the individual's feet until the individual's feet reach the defined height B. Typically, the method includes repeating steps (i), (ii), (iii), (iv), (v), and (vi) for at least two cycles.

In an exemplary embodiment, the method includes monitoring the inspiratory duration and expiratory duration of the individual's breathing cycle, initiating step (iv) after a time period following the initiation of step (i) that substantially matches one repetition of the inspiratory duration of the individual's breathing cycle, and re-initiating step (i) in the second cycle after a time period following the initiation of step (iv) that substantially matches one repetition of the expiratory duration of the individual's breathing cycle.

In yet another exemplary embodiment, the method includes, after step (iii) is completed, holding the individual's head and the individual's feet at the height T for an upper pause period IHOLD before initiating step (iv).

In yet another exemplary embodiment, the method includes, after step (vi) is completed, holding the individual's head and the individual's feet at the height B for a lower pause period EHOLD before re-initiating step (i) in the second cycle.

In yet another exemplary embodiment, the method includes instructing the individual to inhale from the time that step (i) is initiated until step (iv) is initiated and instructing the individual to exhale from the time that step (iv) is initiated until step (i) is re-initiated in the second cycle.

In yet another exemplary embodiment, the method includes continuously monitoring the inspiratory duration and expiratory duration of the individual's breathing cycle and adjusting the initiation of step (i) and the initiation of step (iv) to complement the individual's breathing cycle.

In another aspect, the present invention embraces an apparatus for supporting and moving an individual's body to facilitate breathing. The apparatus includes a platform for supporting the individual's body, a capital support mechanism for supporting and moving the platform, a capital drive mechanism, a pedestal support mechanism for supporting and moving the platform, and a pedestal drive mechanism. The drive mechanisms drive the support mechanisms to raise and lower the platform's capital and pedestal portions.

In an exemplary embodiment, the capital support mechanism includes a first capital platform bar having an upper end connected to the platform's capital portion and the pedestal support mechanism includes a first pedestal platform bar having an upper end connected to the platform's pedestal portion.

In yet another exemplary embodiment, the apparatus includes a capital platform track roller guide system connecting the capital support mechanism to the platform's capital portion and a pedestal platform track roller guide system connecting the pedestal support mechanism to the platform's pedestal portion.

The foregoing illustrative summary, as well as other exemplary objectives and advantages of the invention, and the manner in which the same are accomplished, are further explained within the following detailed description and its accompanying drawings.

DETAILED DESCRIPTION

Figure 9:
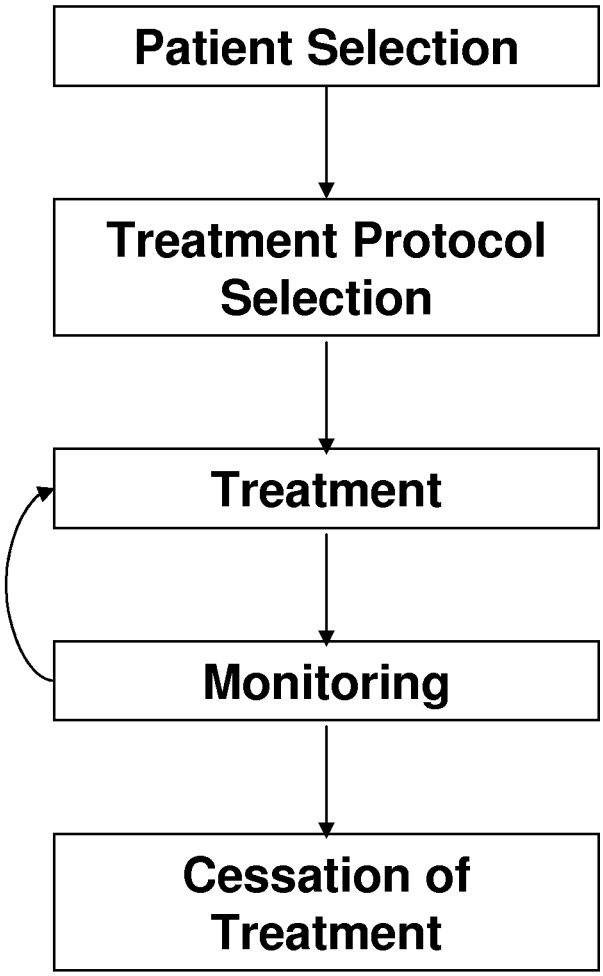
FIG. 9 schematically represents an exemplary treatment method of the present invention.

The present invention embraces a passive exercise method for the treatment of individuals suffering from breathing difficulties that reduces or eliminates sensations of rapid acceleration and provides a more comfortable treatment experience. In use, the parameters of the movement described herein (e.g., heights, times, speed, pause periods) are selected by the user (typically a medical professional, therapist, or the patient) and are based upon the needs of the patient. Preferably this is accomplished by generally following the flowchart set forth in FIG. 9. That is, a patient is selected, the treatment protocol is selected, treatment is initiated, progress is monitored, and depending on the results of that monitoring, either treatment is continued, or it is ceased. These parameters will depend on the goal of the treatment (for example, facilitation of breathing, prevention and treatment of edema or post-surgical adhesions, or improvement of the delivery of inhaled medications), and the condition of the patient. Examples set forth herein describe these parameters.

Example 1

Chronic Obstructive Pulmonary Disease

Patient Selection—Patients expressing indications detailed as Stage III or Stage IV COPD per GOLD standards, as set forth in http://www.goldcopd.org/guidelines-copd-diagnosis-and-management.html of Jul. 1, 2011, are suitable candidates for treatment.

Protocol Selection—Based on patient's normal breathing rate, set device to 10-20% slower than the breathing rate, with 12-17% being more preferred and 15% being most preferred. Initial 5 therapy sessions are at 5 degrees, then 5 therapy sessions at 10 degrees, as tolerated. After ten problem-free therapy sessions, therapy may be increased to 15 degrees. Settings for therapy sessions beyond 15 degrees are at discretion of medical personnel. Patients may receive therapy sessions twice daily as tolerated.

Monitoring—Peak flow and FEV1 are checked during treatment and compared to Pre-treatment peak flow and FEV1. In addition, patient continuously monitored for distress due to excess secretions release (urge to cough) and therapy is interrupted to allow elimination of secretions (cough). SpO2 and EtCO2 may be monitored during therapy for research purposes.

Treatment Duration/Termination—Treatment is suspended by the therapist to support elimination of excess secretion, and is resumed shortly thereafter. Treatment duration is normally 30 minutes unless terminated prematurely due to patient discomfort, or because peak flow and/or FEV1 declines relative to pre-treatment level. Treatment durations beyond 30 minutes are at discretion of medical personnel.

Example 2

Apnea of Prematurity

Patient Selection—Apnea of prematurity is differentiated from other forms of Infant Apnea such as Obstructive Apnea, hypoventilation syndromes, breathing regulation issues during feeding, and reflux associated apnea with an infant Pneumogram or Infant Apnea/Sleep Study. Generally, babies who are born at less than 35 weeks' gestation have periods when they stop breathing or experience bradycardia. These breathing abnormalities may begin after 2 days of life and last for up to 2 to 3 months after the birth. The lower the infant's weight and level of prematurity at birth, the more likely he or she will have AOP. Although it's normal for all infants to have pauses in breathing and heart rates, those with AOP have drops in heart rate below 80 beats per minute, which causes them to become pale or bluish. 6. They may also appear limp and their breathing may be noisy. They then either start breathing again by themselves or require help to resume breathing. Any baby being weaned from positive pressure ventilation would be a candidate.

Protocol Selection—Subject's respiratory rate is monitored with a respiratory belt and the movement of the device is programmed to provide respiratory support at the same rate as the measured rate. Additionally, the device may oscillate at a rate up to twice the measured respiratory rate to stimulate breathing if breathing ceases.

Monitoring—Breathing can be monitored with a variety of devices, including oximetry, capnography, and/or respiratory belt. It is also possible to use an "apnea monitor", which alarms when apnea is detected.

Treatment Duration/Termination—Treatment duration is normally 30 minutes.

Sessions are terminated when subjects vital signs are normal, i.e., HR>80, RR>30, and SpO2>95. Sessions are terminated when subject is transitioned to mechanical positive pressure ventilation upon three apnea alarm events occurring within a 1 hour period.

Example 3

Obstructive Sleep Apnea (OSA)

Patient Selection—Selection is based on Apnea-Hypopnea Index, or AHI. This index is used to assess the severity of sleep apnea based on the total number of complete cessations (apnea) and partial obstructions (hypopnea) of breathing occurring per hour of sleep. These pauses in breathing must last for 10 seconds and are associated with a decrease in oxygenation of the blood. Appropriate subjects will have an AHI between 5 and 30 (mild to severe), as set forth by the American Academy of Sleep Medicine Task Force (1999).

Protocol Selection—Initial setting are with no movement in device. Subject wears any of a variety of respiratory monitors, i.e., respiratory belt, which provide input of respiratory activity. When stable respiratory activity is detected for 5 of cycles, computed respiratory rate and I:E ratio become device settings and motion preferably begins at the target angle of 5%, for both the upward and downward direction, and incrementally increases on each cycle until the maximum angle of 15% is reached. Medical personnel can increase the angle if the motion is tolerated and AHI remains above 5. Medical personnel can reduce the angle if motion is poorly tolerated or if AHI is less than 3. The apparatus may oscillate at the rate determined by the monitored breathing pattern, or up to twice the most recent measured respiratory rate to stimulate breathing, or at any speed therebetweeen. Any disturbance in the respiratory pattern, i.e. cough, talking, etc, will cause the device to return to a neutral state until respiratory stability is again achieved. Cessation of respiration will result in an alarm. The device can be used in conjunction with a CPAP device, which may also monitor and record respiratory activity Monitoring—Breathing can be monitored with a variety of devices, including oximetry, capnography, respiratory belt and/or an apnea monitor, which detects apnea and alarms when apnea is detected.

Treatment Termination—Treatment is terminated when a patient exhibits an AHI <5, upon request, or when patient awakens.

Example 4

Post-Surgical Adhesions or DVT

Patient Selection—Any patient undergoing abdominal or pelvic surgery, whether open or laparoscopic, would be a candidate from surgical adhesion prophylaxis. Any patient undergoing surgery in the hips or lower limbs is a candidate for DVT prophylaxis.

Protocol Selection—The degree of motion is set at the lowest level that will produce visible movement in the abdomen and, if patient is alert and oriented, produce sensation of movement in the patient.

Treatment—Patient is moved to device in PACU/Recovery, or as soon as treatment is tolerated. Patient can remain on device until discharge.

Monitoring—Patient is monitored for any signs or symptoms of hemorrhage, as well as reports of discomfort that ceases with the cessation of movement.

Treatment Termination—Termination upon patient request, any evidence of hemorrhaging, hospital discharge, or as deemed appropriate by medical personnel.

Example 5

Pitting Peripheral Edema

Patient Selection—Any patient with pitting peripheral edema is a candidate. Pitting edema can be demonstrated by applying pressure to the swollen area by depressing the skin with a finger. If the pressing causes an indentation that persists for 3 seconds after the release of the pressure, the edema is referred to as pitting edema. Pitting edema may also be identified by CT or MRI scan, lymphangiography, and/or lymphoscintigraphy.

Protocol Selection—The degree of motion begins at 5 degrees, and increases by 3 degrees every 5 minutes, to a maximum of 15 degrees or reported patient discomfort. Oscillation rate may be set to coincide with of respiratory rate. Treatment can be repeated every 4 hours.

Monitoring—Monitoring is not required, but SpO2 monitoring is optional. Patient can also be monitored for the persistence of edema.

Treatment Termination—Treatment is no longer required when pitting duration is less than 3 seconds, at patient request or at discretion of medical personnel.

Example 6

Increased Efficacy of CPAP or BiPAP (NIPPV)

Patient Selection—A suitable subject is someone who cannot tolerate CPAP prescribed settings, for example the pressure is too high. Same selection as Use for COPD or AOS.

Protocol Selection—Apparatus is initially set with no movement and subject wearing any of a variety of respiratory monitors which provide input of respiratory activity. When stable respiratory activity is detected for 5 of cycles, computed respiratory rate and I:E ratio become device settings and motion begins at 20% of the target angle and increases by an 20% on each cycle until the maximum angle is reached. The maximum angle is 15 degrees up and 15 degrees down, for a total of 30 degrees. Oscillation rate can be set as low as monitored respiration rate, or as fast as twice the monitored respiration rate, or at any rate therebetween. Any disturbance in the respiratory pattern, for example talking or coughing, will cause the device to return to a neutral state until respiratory stability is again achieved. Optionally, the device can be used in conjunction with a CPAP device, with that device monitoring and recording respiratory activity.

Monitoring—Breathing can be monitored with a variety of devices, including oximetry, capnography, respiratory belt and apnea monitor, wherein the cessation of respiration will result in an alarm.

Treatment Termination—Treatment is terminated when AHI <5, patient request or patient awakens, or at discretion of medical personnel.

Example 7

Increased Efficacy of Inhaled Medications

Patient Selection—Patients with high dosage requirements for bronchodilators or corticosteroids delivered by MDI or DPI and poor compliance with self-administration procedure are suitable candidates, especially where decreased respiratory function is a cause of poor compliance. Preferably, subjects with peak flow <70% who are likely to, or who have been prescribed MDI and/or DPI should receive therapy.

Protocol Selection—Subject preferably receives therapy at 15%, and at rate equal to subject's observed respiratory rate. When spirometry is improved by 10%, relative to pre-treatment spirometry measurement, drug may be administered.

Monitoring—Drug administration occurs when subject experiences increase of 2% of SpO2 as measured by pulse oximetry, or alternatively, 15% increase in FEV1.

Treatment Termination—If pre and post spirometry differences are less than 10% after 30 minutes post therapy, or patient reports increased side effects, or at medical personnel discretion, therapy should be terminated.

Figures 10A, 10B, 10C, 10D, 10E, 10F, 10G:
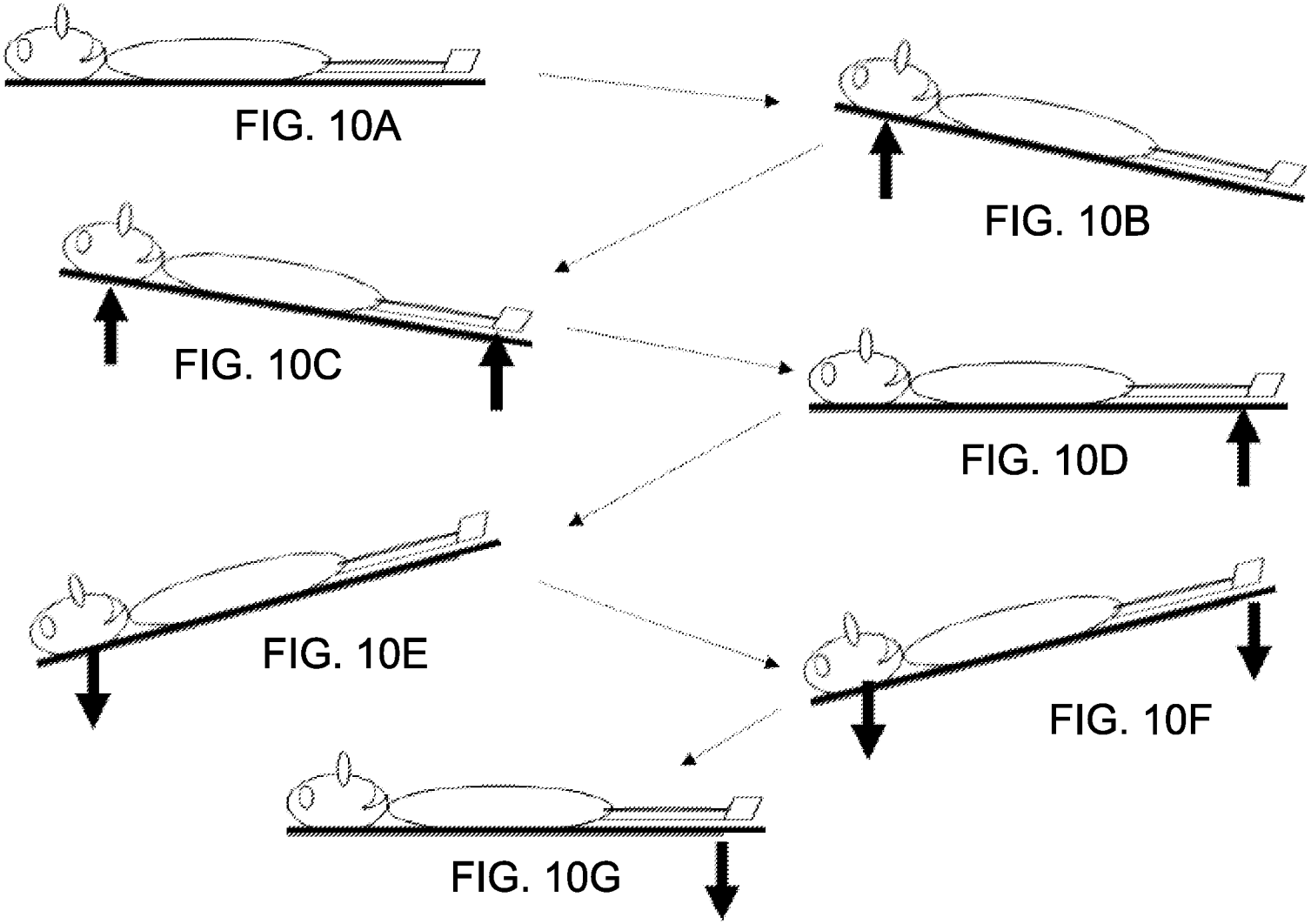
FIGS. 10A-10G schematically represents patient positional changes occurring during an exemplary treatment according to the present invention.
Figure 11A:
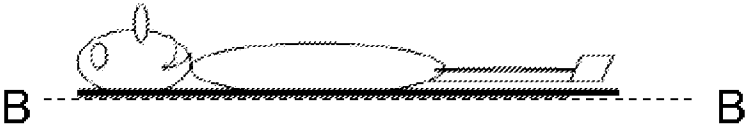
FIGS. 11A-11G schematically represents patient positional changes, relative to baseline, occurring during an exemplary treatment according to the present invention.
Figure 11B:
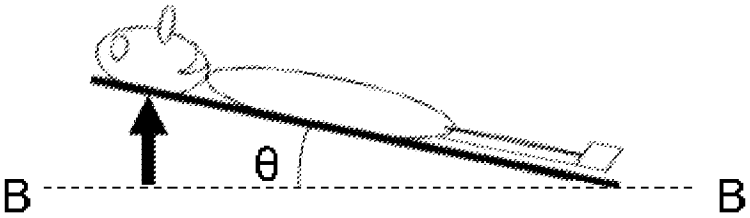
Figure 11C:
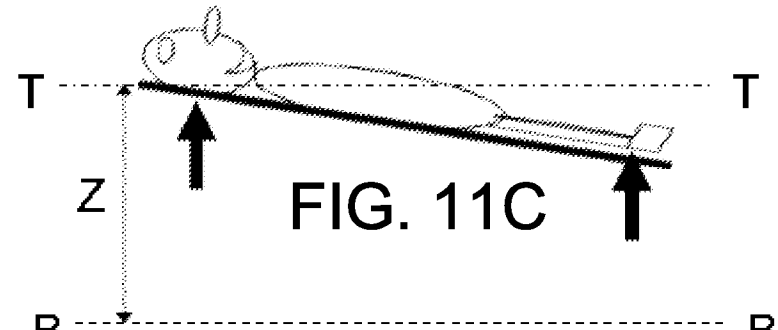
Figure 11D:
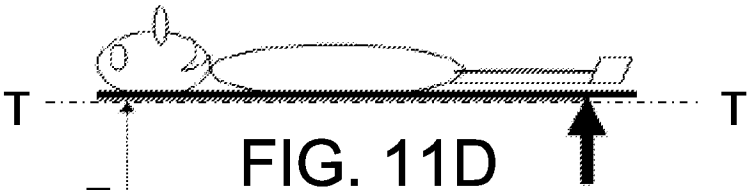

The method includes moving the individual's body through a series of coordinated steps which are set forth in FIGS. 10A-10G and 11A-11G. FIGS. 10A-10G and 11A-11G show the same coordinated steps, except FIGS. 11A-11G represents movement of the body relative to bottom (B) and top (T) positions in space. Typically, the individual is placed in a generally prone or supine position (e.g., on a bed, table, or platform), as shown in FIGS. 10(A) and 11(A). The individual's head is raised without raising the individual's feet, as shown in FIGS. 10(B) and 11(B). Thereafter, the individual's head and feet are raised simultaneously until the individual's head reaches a defined height T, as shown in FIGS. 10(C) and 11(C). The individual's feet are then raised until the individual's feet reach the defined height T, as shown in FIGS. 10(D) and 11 (D). The time period during and speed at which the individual's head is raised without raising the individual's feet place the individual's body at an angle (shown as θ in FIG. 11(B) that defines the upward-intensity of the treatment method.

Figure 11E:
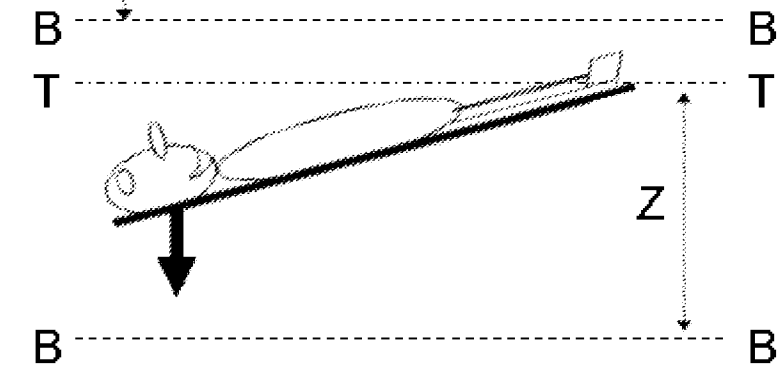

The individual's head is lowered without lowering the individual's feet, as shown in Figures 10(E) and 11(E). This step of lowering the individual's head without lowering the individual's feet may be initiated before the individual's feet reach the defined height T, such that at some point during the method, the individual's head is being lowered while the individual's feet are being raised. Alternatively, this step of lowering the individual's head without lowering the individual's feet may be initiated at the same time or after the individual's feet reach the defined height T.

Figure 11F:
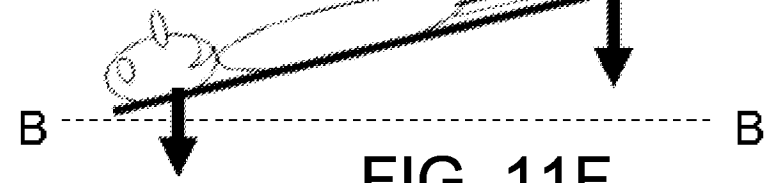
Figure 11G:
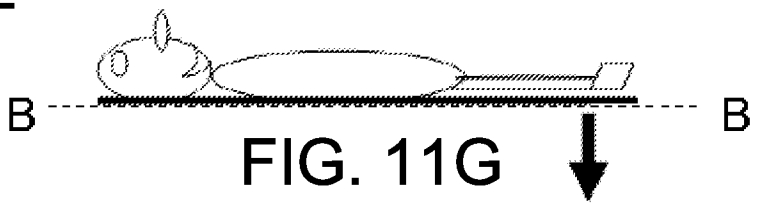

After the step of lowering the individual's head without lowering the individual's feet, the individual's head and feet are lowered simultaneously until the individual's head reaches a height B, as shown in FIGS. 10(F) and 11(F). The individual's feet are then lowered until the individual's feet reach the height B, as shown in FIGS. 10(G) and 11(G). The time period during and speed at which the individual's head is lowered without lowering the individual's feet place the individual's body at an angle that defines the downward-intensity of the treatment method.

The individual's head is again raised without raising the individual's feet to initiate a second cycle of the method. This step of raising the individual's head without raising the individual's feet may be initiated before the individual's feet reach the height B, such that at some point during the method, the individual's head is being raised while the individual's feet are being lowered. Alternatively, this step of raising the individual's head without raising the individual's feet may be initiated at the same time or after the individual's feet reach the height B.

As noted previously, the upper height T and lower height B are selected by the medical professional or therapist treating the patient. The difference between the upper height T and the lower height B defines a vertical translation Z (i.e., T−B =Z) that represents the vertical distance that the individual's body travels during half of a cycle. This is set forth in FIGS. 11(C), 11(D) and 11(E).

In some exemplary embodiments, the individual's head and feet are maintained at the defined height T for a period of time (i.e., an upper pause period) designated "IHOLD." Alveolar collapse, or atelectasis, is a prominent concern when treating patients suffering from shortness of breath, particularly patients with COPD. Although the inventors do not wish to be bound by any particular theory, it appears that this pause in motion (i.e., maintaining the individual's head and feet at the height T) can facilitate the creation of a positive pressure that re-engages alveoli within the lungs that may have collapsed. Thus, a pause in motion while the individual's head and feet are at the defined height T may correct and potentially prevent atelectasis. During the upper pause period IHOLD, the patient may be instructed to continuing trying to inhale (i.e., as opposed to holding their breath). That said, the patient may also be instructed to hold their breath during the upper pause period IHOLD.

In some exemplary embodiments, the individual's head and feet are maintained at the defined height B for a period of time (i.e., a lower pause period) designated "EHOLD." It appears that this pause in motion (i.e., maintaining the individual's head and feet at the height B) can facilitate the contraction of the individual's abdomen to expel additional air from the individual's lungs. Expelling additional air during exhalation allows the lungs to remove additional carbon dioxide from the individual's bloodstream. Thus, a pause in motion while the individual's head and feet are at the defined height B may improve the efficacy of the individual's breathing cycle. During the lower pause period EHOLD, the patient may be instructed to continuing trying to exhale (i.e., as opposed to holding their breath). That said, the patient may also be instructed to hold their breath during the lower pause period EHOLD.

In some exemplary embodiments, the parameters of the movement described herein (e.g., height, time, speed, pause periods) are selected by a medical professional, therapist or the individual based upon the needs of the individual. For example, the parameters of the movement may be prescribed to the individual by a medical professional or therapist. When treating an individual with sleep apnea, these parameters can be determined by conducting a sleep study in the same way that the appropriate settings for a CPAP machine are determined.

In addition to the aforementioned steps involving raising and lowering the individual's head and feet, the method may include monitoring the individual's breathing cycle. In particular, the inspiratory duration and expiratory duration of the individual's breathing cycle are monitored. The monitoring step can be performed in a variety of ways. For example, the individual's breathing cycle may be monitored by measuring the time period over which the individual inhales (i.e., to monitor the inspiratory duration) and exhales (i.e., to monitor the expiratory duration). In some exemplary embodiments, the individual's breathing cycle can be monitored using a respiratory belt (i.e., a device that measures changes in thoracic or abdominal circumference during respiration). Alternatively, the individual's breathing cycle can be monitored using a capnography machine (i.e., a device that monitors the concentration or partial pressure of carbon dioxide ($CO_2$) in respiratory gases).

The method typically includes initiating the step of lowering the individual's head without lowering the individual's feet after a time period following the initiation of the step of raising the individual's head without raising the individual's feet that substantially matches one repetition of the inspiratory duration of the individual's breathing cycle. Performing the method in this manner ensures that the individual's head is located at a height that is greater than or approximately equal to the height of the individual's feet for a period time that corresponds to the inspiratory duration of the individual's breathing. The movement effectively elevates the individual's head with respect to the individual's feet, during which gravity encourages the individual's organs to move toward the individual's feet thereby expanding the lungs in the individual's abdomen. Therefore, substantially matching the time period during which the individual's head is elevated with respect to the individual's feet facilitates the individual's natural ability to inhale.

In exemplary embodiments, the method includes performing the steps of the method such that the time period during which the individual's head is elevated with respect to the individual's feet is greater than the inspiratory duration of the individual's breathing cycle. Moving the individual's body according to this exemplary embodiment facilitates the individual's ability to lengthen the inspiratory duration of the breathing cycle. In other words, increasing the time period during which the individual's head is elevated with respect to the individual's feet can help the individual to inhale for a longer period of time and, thus, breathe in more air per breathing cycle. That said, the time period during which the individual's head is elevated with respect to the individual's feet may be less than the inspiratory duration of the individual's breathing cycle.

The method typically includes reinitiating the step of raising the individual's head without raising the individual's feet to begin a second cycle after a time period following the initiation of the step of lowering the individual's head without lowering the individual's feet that substantially matches one repetition of the expiratory duration of the individual's breathing cycle. Performing the method in this manner ensures that the individual's head is located at a height that is less than or approximately equal to the height of the individual's feet for a period time that corresponds to the expiratory duration of the individual's breathing. The movement effectively elevates the individual's feet with respect to the individual's head, during which gravity encourages the individual's organs to move toward the individual's head thereby compressing the lungs in the individual's abdomen. Therefore, substantially matching the time period during which the individual's feet are elevated with respect to the individual's head facilitates the individual's natural ability to exhale.

In exemplary embodiments, the method includes performing the steps of the method such that the time period during which the individual's feet are elevated with respect to the individual's head is greater than the expiratory duration of the individual's breathing cycle. Moving the individual's body according to this exemplary embodiment facilitates the individual's ability to lengthen the expiratory duration of the breathing cycle. In other words, increasing the time period during which the individual's feet are elevated with respect to the individual's head can help the individual to exhale for a longer period of time and, thus, breathe out more air per breathing cycle. That said, the time period during which the individual's feet are elevated with respect to the individual's head may be less than the expiratory duration of the individual's breathing cycle.

In exemplary embodiments that include maintaining the individual's head and feet at the defined height T for a period of time designated "IHOLD," the time period IHOLD is taken into account when matching the inspiratory duration of the individual's breathing cycle. Similarly, in exemplary embodiments that include maintaining the individual's head and feet at the defined height B for a period of time designated "EHOLD," the time period EHOLD is taken into account when matching the expiratory duration of the individual's breathing cycle.

The ratio of the inspiratory duration of the individual's breathing cycle to the expiratory duration of the individual's breathing cycle can be expressed as a ratio IP:EP. In some exemplary embodiments, the aforementioned steps can be carried out to adjust the individual's breathing cycle to a desired ratio IP:EP. In other words, the time period during which the individual's head is elevated with respect to the individual's feet may be increased or decreased with respect to the inspiratory duration of the individual's breathing cycle and the time period during which the individual's feet are elevated with respect to the individual's head may be increased or decreased with respect to the expiratory duration of the individual's breathing cycle to achieve a particular ratio IP:EP. In a particular embodiment, the method is performed to adjust the individual's breathing cycle to achieve a particular ratio IP:EP of less than one (i.e., an expiratory duration that is longer than the inspiratory duration). For example, the method may be performed to adjust the individual's breathing cycle to achieve an IP:EP ratio of approximately 1:2 (i.e., an expiratory duration that is twice as long as the inspiratory duration).

In an exemplary embodiment, the steps of the method are performed to adjust the individual's breathing cycle to a desired inspiration period IP. As previously discussed, this can be achieved by increasing or decreasing the time period during which the individual's head is elevated with respect to the individual's feet as well as the upper pause period IHOLD. In one embodiment, the method is performed to achieve an inspiration period IP of about two seconds.

Similarly, in some exemplary embodiments, the steps of the method are performed to adjust the individual's breathing cycle to a desired expiration period EP. This can be achieved by increasing or decreasing the time period during which the individual's feet are elevated with respect to the individual's head as well as the lower pause period EHOLD. In one embodiment, the method is performed to achieve an expiration period EP of between about four seconds and six seconds.

As previously discussed, the method includes a step of simultaneously raising the individual's head and the individual's feet as well as a step of simultaneously lowering the individual's head and the individual's feet. Thus, in contrast to other passive exercise methods, the method of the invention moves the individual's body through a motion that is more complex than a simple rotation around a fixed pivot axis.

In an exemplary embodiment, the method includes moving one or more axes of rotation while simultaneously rotating an individual's body about the one or more axes. In other words, the individual's body is rotated about one or more axes, and the axes themselves are moved. For example, the axes (i.e., one or more axes of rotation) may be moved in a vertical motion or a horizontal motion (i.e., vertical or horizontal with respect to a floor surface). In some exemplary embodiments, the axes are moved in a motion that has both a vertical component V and a horizontal component H. Thus, during one cycle of the method, the axes are moved a vertical distance V and a horizontal distance H. In exemplary embodiments that include moving multiple axes of rotation, the axes of rotation are typically moved the same vertical distance V and the same horizontal distance H. That said, it is within the scope of the present invention to employ methods that include moving multiple axes of rotation different vertical distances and different horizontal distances.

In some exemplary embodiments, the method includes (i) moving a first axis of rotation in an upward vertical motion, while simultaneously rotating the individual's body in a clockwise rotational direction about the moving first axis of rotation and then (ii) moving the first axis of rotation in a downward vertical motion, while simultaneously rotating the individual's body in a counter-clockwise rotational direction about the moving first axis of rotation. Typically, these steps are repeated for at least two cycles. In an exemplary embodiment, the method includes, after step (i) and before step (ii), rotating the individual's body in a counter-clockwise rotational direction about a second axis of rotation until the individual's body is horizontal. The method may also include, after step (ii) and before step (i) is repeated, rotating the individual's body in a clockwise rotational direction about a third axis of rotation until the individual's body is horizontal. In some embodiments, during step (i), the individual's body is rotated in a clockwise rotational direction to a first angle that defines the upward-intensity of the treatment method. Similarly, during step (ii), the individual's body may be rotated in a counter-clockwise rotational direction to a second angle that defines the downward-intensity of the treatment method.

Furthermore, during the method of the present invention, the individual's entire body is typically moved through the same range of motion as the individual's head. An individual's vestibular system, which contributes to sensations of balance and spatial orientation, is located within the individual's head. Thus, by moving an individual's entire body through the same range of motion as the individual's head, the method of the present invention reduces sensations of rapid acceleration and generally increases the individual's comfort level during treatment.

In exemplary embodiments, the speed at which the individual's head is raised or lowered may be progressively decreased as the individual's head approaches the two defined heights T and B. Similarly, the speed at which the individual's head is raised or lowered may be progressively increased as the individual's head moves further away from the two defined heights T and B. The speed at which the individual's feet are raised or lowered may also be progressively decreased as the individual's feet approaches the two defined heights T and B, and the speed at which the individual's feet are raised or lowered may be progressively increased as the individual's feet move further away from the two defined heights T and B. Thus, uncomfortable, rapid accelerations at points of reversal may be avoided.

The treatment method can be performed on a conscious patient or an unconscious patient (e.g., a sleeping individual). When the patient is conscious, the method may include providing auditory or visual signals to the individual indicating a time to begin inhaling, a time to hold their breath, and/or a time to begin exhaling. In this regard, using auditory or visual cues in conjunction with the above-described treatment method may be supplemented by stimulating the individual with the same auditory or visual cues while the individual is not being moved.

In some exemplary embodiments, the method includes an initial ramp-up period. During the initial ramp-up period, the individual's head and feet are raised and lowered in the same manner described above, but, rather than raising and lowering the individual's head and feet to the defined heights T and B, the individual's head and feet are raised and lowered to intermediate heights between T and B that increase as the cycle is repeated. For example, during the first cycle of the initial ramp-up period, the individual's head and feet may be raised to an intermediate height equal to one-third of T (i.e., T/3) and lowered to an intermediate height equal to one-third of B (i.e., B/3). During the second cycle of the initial ramp-up period, the individual's head and feet may be raised to an intermediate height equal to two-thirds of T (i.e., 2T/3) and lowered to an intermediate height equal to two-thirds of B (i.e., 2B/3). Then, the typical cycles of the method may be carried out by raising and lowering the individual's head and feet to the defined heights T and B. The length and intermediate heights of the initial ramp-up period can be adjusted by a medical professional, therapist, or even the individual.

Similarly, the method may include a final ramp-down period. The final ramp-down period is similar to the initial ramp-up period, except that the intermediate heights of the final ramp-down period decrease progressively as the final ramp-down period is performed. Again, the length and intermediate heights of the final ramp-down period can be adjusted by a medical professional, therapist, or even the individual.

As previously noted, the treatment method can be performed on an unconscious patient, such as an individual suffering from sleep apnea. The sleeping individual's breathing cycle can be monitored using a respiratory belt, oximetry sensor, or a capnography machine. The treatment method can be initiated while the individual is exhibiting a normal breathing cycle (i.e., the individual is not experiencing any apneas or hypopneas) to support the normal breathing cycle. In this regard, the method can be performed according to the parameters prescribed to the individual by a medical professional or therapist. The treatment method may also include rapidly and repeatedly raising and lowering the individual's head and feet a short distance during an apnea or hypopnea to encourage normal breathing or to wake the individual.

Although the treatment method of the present invention can be carried out using a variety of different devices (e.g., a rigid, flexible, or segmented platform manipulated using a variety of devices, motors, or a pulley system), the present inventors have developed a particularly suitable device that will be further described herein. This surface may be open and accessible or may be embedded in other medical devices, such as a hyperbaric chamber.

In another aspect, the present invention embraces an apparatus for supporting and moving an individual's body to facilitate breathing. In this aspect, the apparatus can carry out the various movements associated with the method aspects of the invention. The apparatus includes a platform for supporting the individual's body that has a top surface and a bottom surface and defines a capital portion and a pedestal portion. The capital portion generally supports the upper portion of the individual's body (e.g., from about the waist of the individual to the individual's head). The pedestal portion generally supports the lower portion of the individual's body (e.g., from about the waist of the individual to the individual's feet).

As used herein, the adjective "capital" describes a portion of the apparatus that is generally located toward the end of the apparatus that supports the individual's head. Additionally, the adjective "pedestal" is used to describe portions of the apparatus that are generally located toward the end of the apparatus that supports the individual's feet.

In typical embodiments of the apparatus, the platform is substantially rigid. That said, it is within the scope of the present invention to employ a flexible platform or a segmented platform (i.e., a platform including segments that can move independently of one another). In some embodiments, the platform includes a mechanism for warming the individual's body, such as heating coils. The platform may also include a mechanism for vibrating or massaging the individual's body to encourage the expectoration of mucus or other secretions. Furthermore, the platform may include one or more retention devices to hold the patient on the platform during motion. Retention devices may include a foot rest, a belt, a shoulder block, a foam covering (e.g., a three-inch latex memory foam), or a combinations of one or more of the listed items.

The apparatus includes a capital support mechanism for supporting and moving the platform. The capital support mechanism includes at least one capital platform bar that has an upper end connected to the platform's capital portion. In an exemplary embodiment, the capital support mechanism also includes at least one capital link. The capital link is pivotally connected to the capital platform bar along the capital platform bar's length.

Similarly, the apparatus includes a pedestal support mechanism for supporting and moving the platform. The pedestal support mechanism includes at least one pedestal platform bar that has an upper end connected to the platform's pedestal portion. In an exemplary embodiment, the pedestal support mechanism also includes at least one pedestal link. The pedestal link is pivotally connected to the pedestal platform bar along the pedestal platform bar's length.

In some embodiments, the upper ends of the capital and pedestal platform bars are connected to the platform via a track roller guide system which allows the platform to roll horizontally across the upper ends of the platform bars while maintaining a vertical supporting force. The track roller guide system includes a track roller and a track roller guide. Typically, the track roller guide is positioned on the platform (e.g., on the bottom surface of the platform), and the track roller is placed on the upper end of a platform bar. In exemplary embodiments, the platform includes at least one capital platform track roller guide positioned on the bottom surface of the platform's capital portion. The capital platform bar's upper end may be connected to the platform's capital portion via the capital platform track roller guide. Similarly, the platform may include at least one pedestal platform track roller guide positioned on the bottom surface of the platform's pedestal portion. The pedestal platform bar's upper end may be connected to the platform's pedestal portion via the pedestal platform track roller guide.

The apparatus typically includes at least one capital drive mechanism that is connected to the capital support mechanism and at least one pedestal drive mechanism that is connected to the pedestal support mechanism. The capital drive mechanism drives the capital support mechanism to raise and lower the platform's capital portion, while the pedestal drive mechanism drives the pedestal support mechanism to raise and lower the platform's pedestal portion. Typically, the capital drive mechanism and the pedestal drive mechanism function independently of each other. The drive mechanisms may be linear actuators, pneumatic actuators, pneumatic cylinders, pneumatic motors, hydraulic actuators, hydraulic pistons, rotating motors, servomechanisms, or other controllable devices capable of imparting a substantially linear force. In some embodiments, an individual drive mechanism is a combination of one or more devices working in combination. The apparatus may include one or more dampeners to smooth the mechanical operation of the drive mechanisms.

In some exemplary embodiments, the apparatus includes sound suppression material to reduce sounds created by the drive mechanisms during operation. The sound suppression material may further enhance the comfort of the treated individual.

The apparatus can move an individual's body through a series of coordinated steps generally corresponding to the aforementioned method. Typically, the individual is placed in a generally prone or supine position on the platform. The platform's capital portion is raised by driving the capital support mechanism with the capital drive mechanism while the platform's pedestal portion is not raised (e.g., while the platform's pedestal portion is being lowered or maintained at a particular height). Thereafter, the capital drive mechanism and capital support mechanism raise the platform's capital portion while the pedestal drive mechanism and pedestal support mechanism simultaneously raise the platform's pedestal portion until the platform's capital portion reaches a defined height T. The pedestal support mechanism and pedestal drive mechanism then raise the platform's pedestal portion until the platform's pedestal portion reaches the defined height T.

The platform's capital portion is lowered by driving the capital support mechanism with the capital drive mechanism while the platform's pedestal portion is not lowered (e.g., while the platform's pedestal portion is being raised to the defined height T or after the platform's pedestal portion reaches the defined height). Thereafter, the platform's capital portion is lowered by driving the capital support mechanism with the capital drive mechanism while the pedestal drive mechanism and pedestal support mechanism simultaneously lower the platform's pedestal portion until the platform's capital portion reaches a defined height B. The pedestal support mechanism and pedestal drive mechanism then lower the platform's pedestal portion until the platform's pedestal portion reaches the defined height B.

The apparatus can move the entire length of the platform through a vertical translation (i.e., from the height B to the height T) while simultaneously, independently lowering and raising the platform's capital and pedestal portions. In this regard, the apparatus rotates the platform (and thus the individual's body) around an axis that may be vertically translated, rather than a fixed axis.

Figure 1:
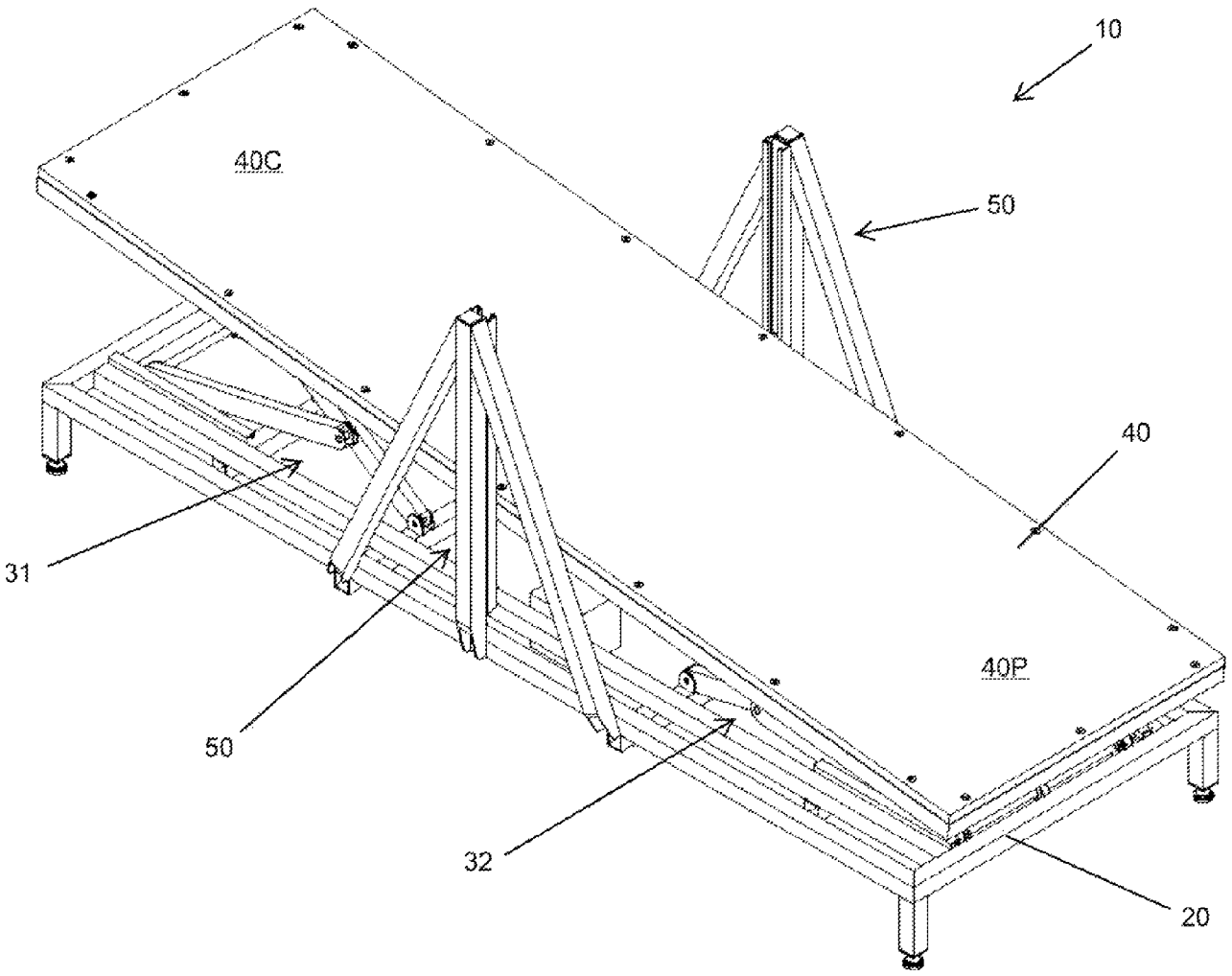
FIG. 1 is a perspective view of an exemplary apparatus according to the present invention with the platform in a lower position.

FIG. 1 depicts an exemplary apparatus 10 according to the present invention. The apparatus 10 includes a base 20, a pedestal support mechanism 32, a capital support mechanism 31, a platform 40, and a stabilization structure 50. In FIG. 1, the platform 40 is in a relatively low position within its motion. As depicted, the platform's capital portion 40C is elevated relative to the platform's pedestal portion 40P.

In the illustrated embodiment, the base 20 is generally rectangular and is formed of a material with the structural strength to support the remaining weight of the apparatus as well as the weight of a patient. Structural metals and metal alloys are appropriate and those of ordinary skill in the art are familiar with the relevant choices (e.g., aluminum alloys and steel alloys). In the illustrated embodiment, the base 20 is constructed of a plurality of square cross-section tubular metal members.

The capital and pedestal support mechanisms 31 and 32 are likewise formed of a similar structural metal. It will be understood, of course, that structurally the elements (e.g., the support mechanisms 31 and 32 and the base 20) need to support the platform 40 throughout its appropriate motion, and any material that serves this purpose will be appropriate including, for example, engineering polymers or fiber-polymer composites.

Figure 2:
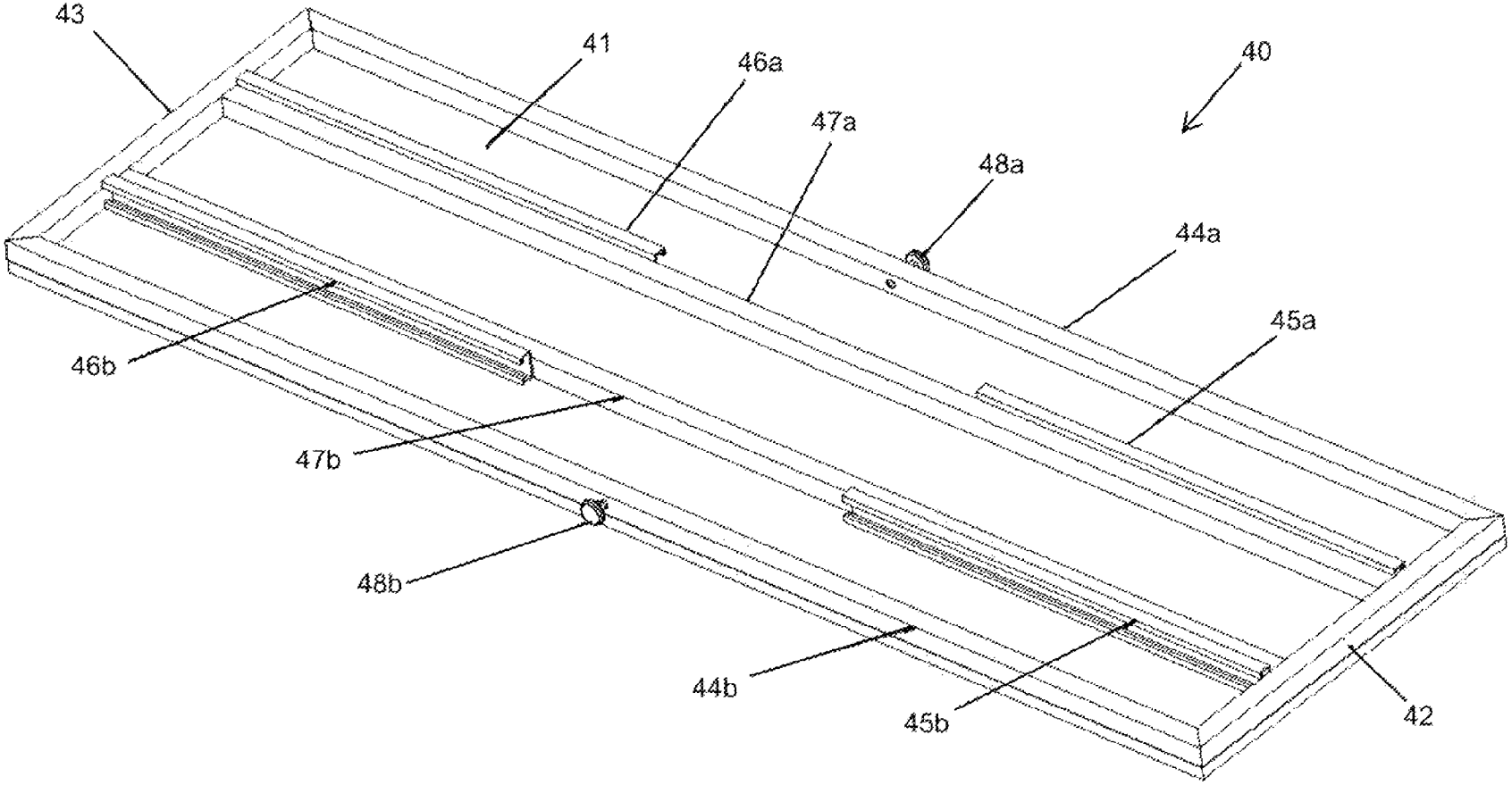
FIG. 2 is a perspective view of the underside of the platform of an exemplary embodiment of the apparatus according to the present invention.

FIG. 2 depicts aspects of the platform 40 of an exemplary embodiment of the apparatus according to the invention. The platform 40 includes a surface 41, the bottom of which is shown in FIG. 2. The platform 40 also includes a pedestal platform bar 42, a capital platform bar 43, a first longitudinal platform bar 44*a*, and a second longitudinal platform bar 44*b*. The combination of these four bars forms a generally rectangular frame that supports the platform 40. In the illustrated embodiment the platform 40 is generally planar and rectangular and is formed of a material that can support the weight of the patient. Metals, polymers, and composites are appropriate materials and can be selected by those of ordinary skill in this art without undue experimentation. The platform's surface 41 may be fixed to the frame with a series of fasteners (not shown), or (in the case of selected metals) welds, or an appropriate adhesive. These are, of course, exemplary rather than limiting of the structure of the platform 40.

A first platform brace 47*a* and a second platform brace 47*b* extend along the length of the platform 40 between the capital platform bar 43 and the pedestal platform bar 42 to provide additional structural support and rigidity to the platform 40.

A first capital platform track roller guide 46*a* and a first pedestal platform track roller guide 45*a* are shown attached to the first platform brace 47*a*. Similarly, in the illustrated embodiment, a second capital platform track roller guide 46*b* and a second pedestal platform track roller guide 45*b* are shown attached to the second platform brace 47*b*. The platform track roller guides 45*a*, 45*b*, 46*a* and 46*b* may also be attached to the surface 41 or the longitudinal platform bars 44*a* and 44*b*; however, the attachment of the platform track roller guides 45*a*, 45*b*, 46*a* and 46*b* should be achieved in such a manner that the platform track rollers 35*a*, 35*b*, 36*a*, 36*b* (See FIGS. 5A-5C and 7A-7C) may roll freely within the platform track roller guides 45*a*, 45*b* ,46*a* and 46*b*. The platform 40 also includes a first vertical track roller 48*a* and a second vertical track roller 48*b* positioned on opposite sides of the platform 40. As depicted, the vertical track rollers 48*a* and 48*b* are attached to the longitudinal platform bars 44*a* and 44*b*; however, the vertical track rollers 48*a* and 48*b* may be attached to the platform 40 in a variety of configurations (e.g., on mounting plates extending upward or downward from the platform 40) and in a variety of locations (e.g., on the capital end of the platform 40 and the pedestal end of the platform 40).

Figure 3:
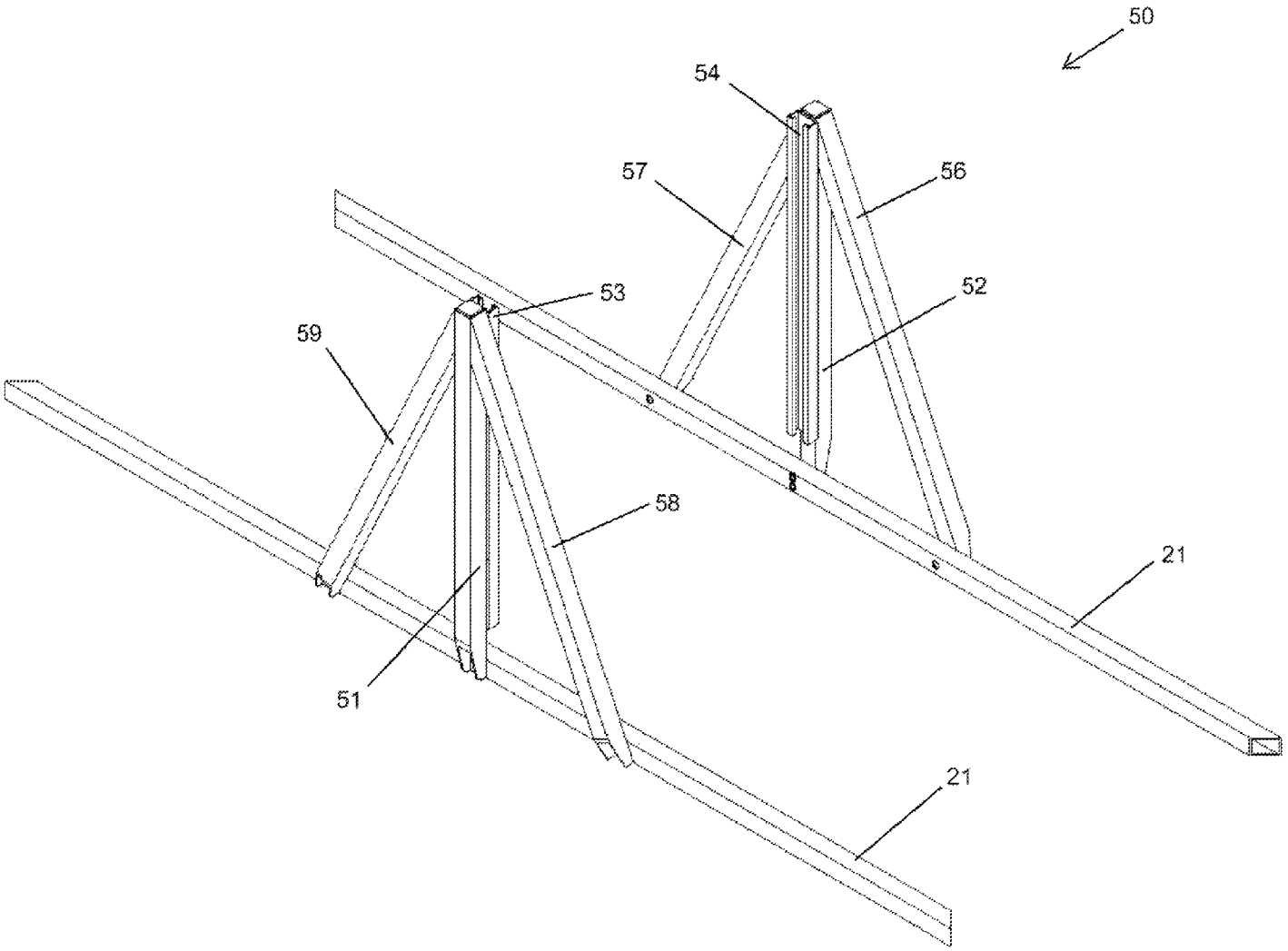
FIG. 3 is a perspective view of a stabilization structure that may be included in some exemplary embodiments of the apparatus of the present invention.

FIG. 3 depicts aspects of the stabilization structure broadly designated at 50 that may be included in some exemplary embodiments of the apparatus 10 of the present invention. The stabilization structure 50 prevents substantial, undesired, horizontal movement of the platform 40. As shown, the stabilization structure 50 may be connected to part of the base frame 21. The stabilization structure 50 includes a first vertical bar 51 and a second vertical bar 52 that are positioned on opposite sides of the base frame 21. As depicted, the vertical bars 51 and 52 are positioned on the left and right sides of the base frame 21. In some embodiments, the vertical bars 51 and 52 may be positioned at the capital end of the base frame 21 and the pedestal end of the base frame 21. The stabilization structure 50 may also include support bars 56, 57, 58, and 59 arranged as a truss structure to provide additional rigidity to the stabilization structure 50. In the illustrated embodiment, the support bars 56, 57, 58, and 59 are likewise formed of tubular metal with a generally square cross section. As in the case of other structural elements, however, other structurally appropriate materials and geometries can serve the same purpose.

The stabilization structure 50 also includes a first vertical track roller guide 53 and a second vertical track roller guide 54. As shown, the vertical track roller guides 53 and 54 are positioned on the vertical bars 51 and 52. The vertical track rollers 48*a* and 48*b* (FIG. 2) of the platform 40 can travel within the vertical track roller guides 53 and 54 to prevent substantial horizontal movement of the platform 40, while allowing the platform 40 to move vertically (i.e., up and down).

Figure 4:
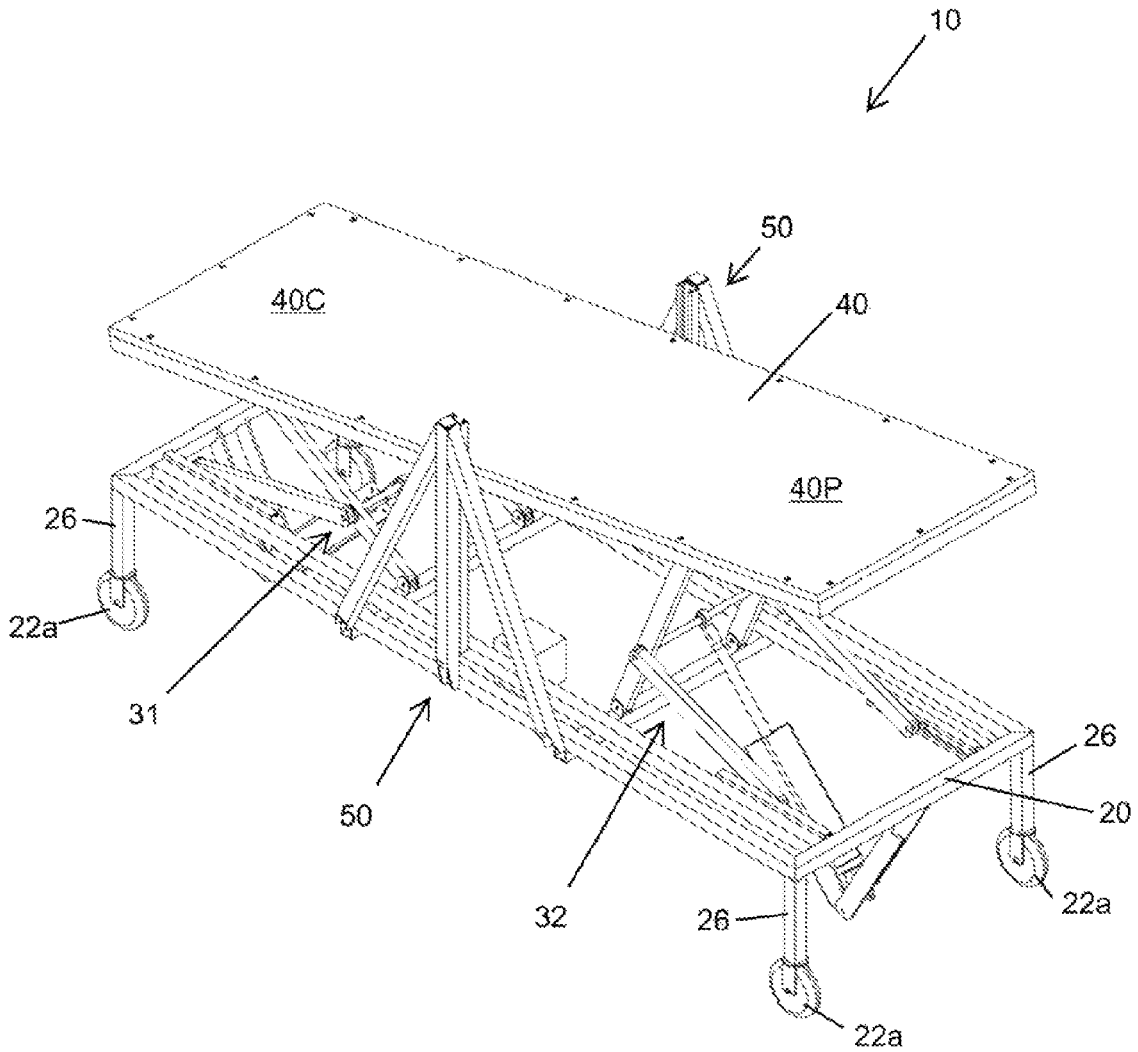
FIG. 4 is a perspective view of a first exemplary embodiment of the apparatus of the present invention in an elevated position.

FIG. 4 depicts a first exemplary embodiment of the apparatus 10 in an elevated position. The apparatus 10 includes a base 20, a pedestal support mechanism 32, a capital support mechanism 31, a platform 40, and a stabilization structure 50. As depicted, the platform's pedestal portion 40P is elevated relative to the capital portion of the platform 40. FIG. 4 also illustrates that the base 20 is supported by four posts 26, three of which are visible in the orientation of FIG. 4. Each post 26 carries a respective wheel 22*a*.

Figure 5A:
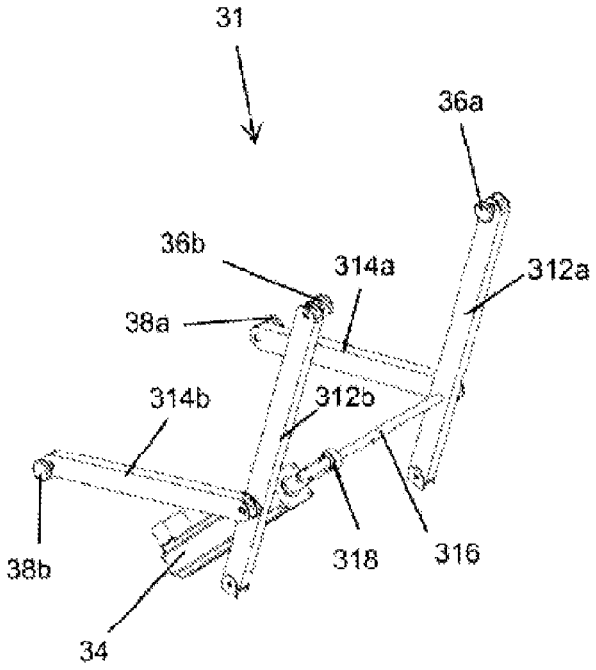
FIGS. 5A, 5B and 5*c* are partial perspective views of the support mechanisms and drive mechanisms of the first exemplary embodiment of the apparatus of the present invention.
Figure 5B:
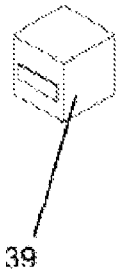
Figure 5C:
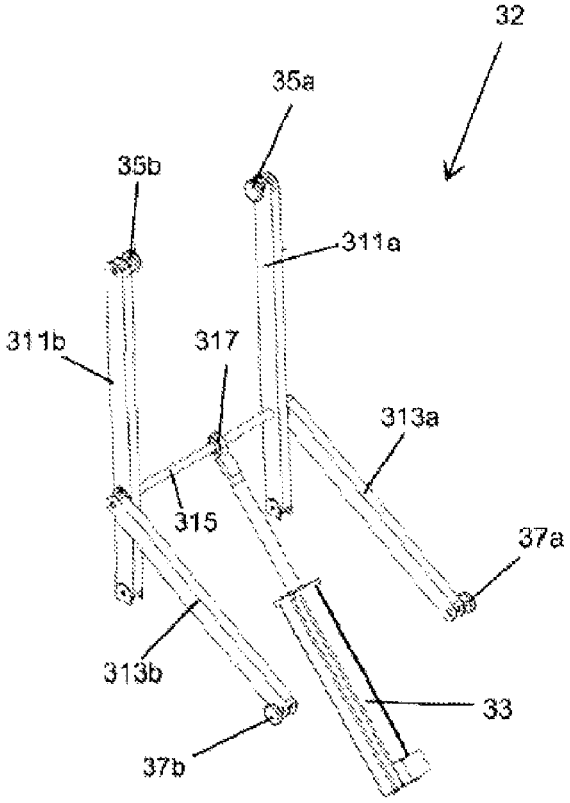

FIGS. 5A-5C depicts the support mechanisms and drive mechanisms of the first exemplary embodiment of the apparatus of the present invention. FIGS. 5A-5C shows a controller 39 that controls the pedestal drive mechanism 33 and the capital drive mechanism 34. The drive mechanisms 33 and 34 can operate independently of one another. As depicted, the drive mechanisms 33 and 34 are linear actuators, but other devices capable of driving the support mechanisms 31 and 32 may be also be used. The controller 39 typically controls the drive mechanisms 33 and 34 to perform a particular series of steps or travel through a continuous motion. The drive mechanisms 33 and 34 drive the support mechanisms 31 and 32 which move the platform 40. The basic principles of controllers (e.g., including processors and electronic circuits) are well understood in the electrical engineering arts and will not be described in detail herein. Appropriate and representative (but not limiting) descriptions are set forth in widely available sources such as Dorf, The Electrical Engineering Handbook, 2d Ed., CRC Press (1997).

The pedestal support mechanism 32 includes a first pedestal link 313*a* pivotally connected along the length of a first pedestal platform bar 311*a* and a second, generally parallel, pedestal link 313*b* pivotally connected along the length of a second pedestal platform bar 311*b*. Similarly, the capital support mechanism 31 includes a first capital link 314*a* pivotally connected along the length of a first capital platform bar 312*a* and a second capital link 314*b* pivotally connected along the length of a second capital platform bar 312*b*.

The pedestal platform track rollers 35*a* and 35*b* are attached to the upper ends of the pedestal platform bars 311*a* and 311*b*, and the capital platform track rollers 36*a* and 36*b* are similarly attached to the upper ends of the capital platform bars 312*a* and 312*b*. The platform track rollers 35*a*, 35*b*, 36*a*, 36*b* can be placed in the platform track roller guides 45*a*, 45*b*, 46*a*, and 46*b* on the platform 40 (See FIG. 2). As previously discussed, the platform track roller guide system allows the platform 40 to roll horizontally across the upper ends of the platform bars 311*a*, 311*b*, 312*a*, and 312*b* while maintaining a supporting vertical force on the platform 40.

The pedestal base track rollers 37*a* and 37*b* are attached to the ends of the pedestal links 313*a* and 313*b*, while the capital base track rollers 38*a* and 38*b* are attached to the ends of the capital links 314*a* and 314*b*. The base track rollers 37*a*, 37*b*, 38*a*, and 38*b* can be placed in the base track roller guides 27*a*, 27*b*, 28*a*, and 28*b* (See FIG. 6). The base track roller guide system allows the ends of the links 313*a*, 313*b*, 314*a*, and 314*b* to roll horizontally while maintaining a supporting vertical force.

The pedestal support mechanism 32 also includes a pedestal cross-shaft 315 that connects the pedestal platform bars 311*a* and 311*b*, and the capital support mechanism 31 includes a capital cross-shaft 316 that connects the capital platform bars 312*a* and 312*b*. The cross-shafts 315 and 316 also provide a point of contact for the pedestal and capital drive mechanisms 33 and 34. The pedestal drive mechanism 33 is connected to the pedestal support mechanism 32 with a pedestal spherical rod end 317 connected to the pedestal cross-shaft 315. The capital drive mechanism 34 is connected to the capital support mechanism 31 with a capital spherical rod end 318 connected to the capital cross-shaft 316. Spherical rod ends 317 and 318, also known as "heim joints" or "rose joints," include a ball swivel with an opening (e.g., through which the cross-shafts 315 and 316 may pass) pressed into a circular casing with a threaded shaft attached.

As depicted, the cross-shafts 315 and 316 connect the platform bars 311*a*:311*b* and 312*a*:312*b* at approximately the same location along the length of the platform bars 311*a*, 311*b*, 312*a*, and 312*b* at which the links 313*a*, 313*b*, 314*a*, and 314*b* are connected. In this regard, the cross-shafts 315 and 316 may also pass through the platform bars 311*a*, 311*b*, 312*a*, 312*b* and connect the links 313*a*, 313*b*, 314*a*, and 314*b* to their respective platform bars. The cross-shafts 315 and 316 may be connected to the platform bars 311*a*, 311*b*, 312*a*, and 312*b* at other locations in other embodiments to facilitate control over the motion of the platform 40 during operation.

As depicted, the drive mechanisms 33 and 34 are connected to the support mechanisms 31 and 32 at approximately the same angle, which is neither horizontal, nor vertical (i.e., with respect to the ground). In other embodiments of the apparatus, the drive mechanisms 33 and 34 may be connected to their respective support mechanisms 31 and 32 at different angles from each other, and at angles that are substantially vertical or horizontal. Typically, the angle of attachment is altered depending on the type and functionality of the drive mechanisms 33 and 34.

As previously discussed with respect to the method aspects of the present invention, the device of the invention typically moves one or more axes of rotation while simultaneously rotating the platform 40 about one or more axes. In other words, the platform 40 is rotated about one or more axes, and the axes themselves are moved. For example, the upper ends of the pedestal platform bars 311*a* and 311*b* may define one axis of rotation, and the upper ends of the capital platform bars 312*a* and 312*b* may define another axis of rotation. Alternatively, an axis of rotation may be located along the platform 40 between the upper ends of the pedestal platform bars 311*a* and 311*b* and the upper ends of the capital platform bars 312*a* and 312*b*. In this regard, the axis (or axes) may be moved in a vertical motion or a horizontal motion (i.e., vertical or horizontal with respect to a floor surface). In some exemplary embodiments, the axes are moved in a motion that has both a vertical component V and a horizontal component H. Thus, during one cycle, the axes are moved a vertical distance V and a horizontal distance H. Accordingly, the drive mechanisms 33 and 34 are typically capable of moving the support mechanisms 31 and 32 to achieve such a motion. Furthermore, the platform track roller guide system can facilitate the achievement of such a motion.

Figure 6:
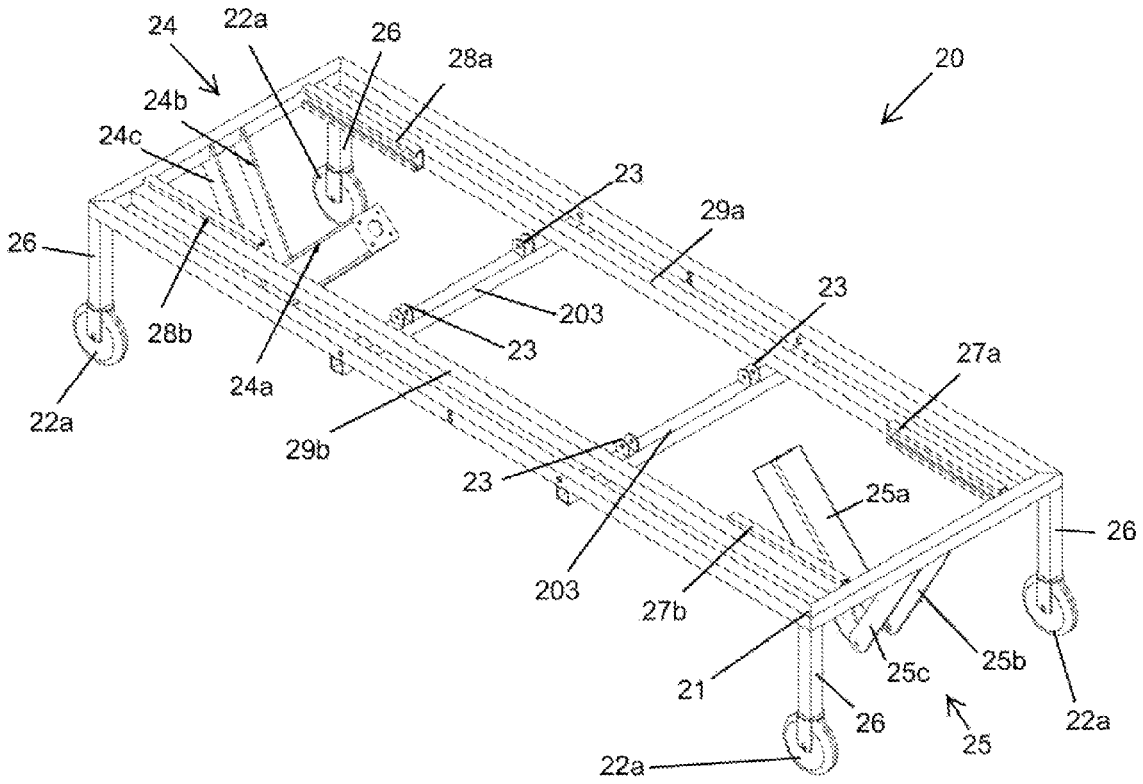
FIG. 6 is a perspective view of the base of the first exemplary embodiment of the apparatus of the present invention.

FIG. 6 depicts the base 20 of the first exemplary embodiment of the apparatus of the present invention. The base 20 includes a generally rectangular base frame 21 that provides a supporting foundation for the apparatus. The base 20 also includes four posts 26 connected to four base wheels 22*a* attached at or near the corners of base frame 21. A first base brace 29*a* and a second base brace 29*b* extend along the length of the base 20 generally parallel to one another and to the side of the base frame 21. A first pedestal base track roller guide 27*a* and first capital base track roller guide 28*a* are connected to opposite ends of the first base brace 29*a*. A second pedestal base track roller guide 27*b* and a second capital base track roller guide 28*b* are connected to opposite ends of the second base brace 29*b*. As previously noted, the base track rollers 37*a*, 37*b*, 38*a*, and 38*b* (See FIGS. 5A-5C) can be placed in the base track roller guides 27*a*, 27*b*, 28*a*, and 28*b*. The base track roller guide system allows the ends of the links 313*a*, 313*b*, 314*a*, and 314*b* (See FIGS. 5A-5C) to roll horizontally while maintaining a supporting vertical force.

Two base pivot supports 203 extend across the width of the base 20. The base pivot supports include bar pivot tabs 23 that provide a pivoting connection to the lower ends of the platform bars 311*a*, 311*b*, 312*a*, and 312*b* (See FIGS. 5A-5C). By pivotally connected to the base pivot supports 203, the lower ends of the platform bars 311*a*, 311*b*, 312*a*, and 312*b* remain fixed while the apparatus is in operation and provide support to the platform 40. In alternative embodiments, the lower ends of the platform bars 311*a*, 311*b*, 312*a*, and 312*b* may be pivotally connected to a floor surface or provided with a rounded edge (e.g., a rubberized rounded edge) that simply rests on the floor surface. In these alternative embodiments, the entire apparatus 10 may be connected to the floor.

The base 20 also includes a capital drive mount 24 and a pedestal drive mount 25 on which the drive mechanisms 33 and 34 (See FIGS. 5A-5C) can be mounted. As depicted, the drive mounts 24 and 25 are three-piece mounts that complement the angle of the drive mechanisms 33 and 34. In this regard, the pedestal drive mount 25 includes mount 25*a* and two supports 25*b* and 25*c*, and the capital drive mount 24 includes mount 24*a* and two supports 24*b* and 24*c*. Typically, the drive mounts 24 and 25 are attached to the base 20 in a manner that provides appropriate support for the drive mechanisms 33 and 34.

Figure 7A:
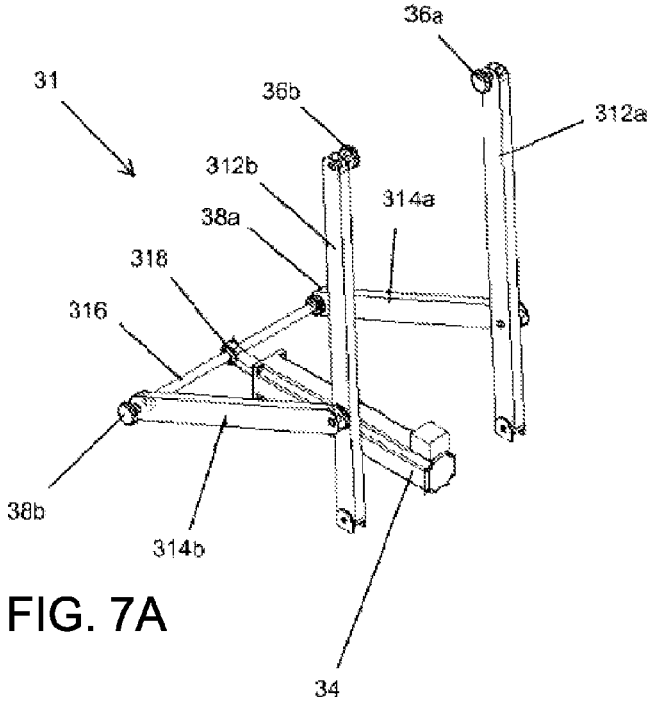
FIGS. 7A, 7B and 7c are partial perspective views of the support mechanisms and drive mechanisms of a second exemplary embodiment of the apparatus of the present invention.
Figure 7B:
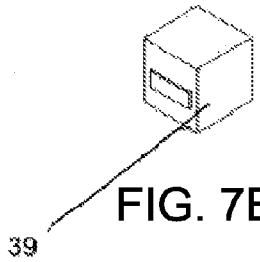
Figure 7C:
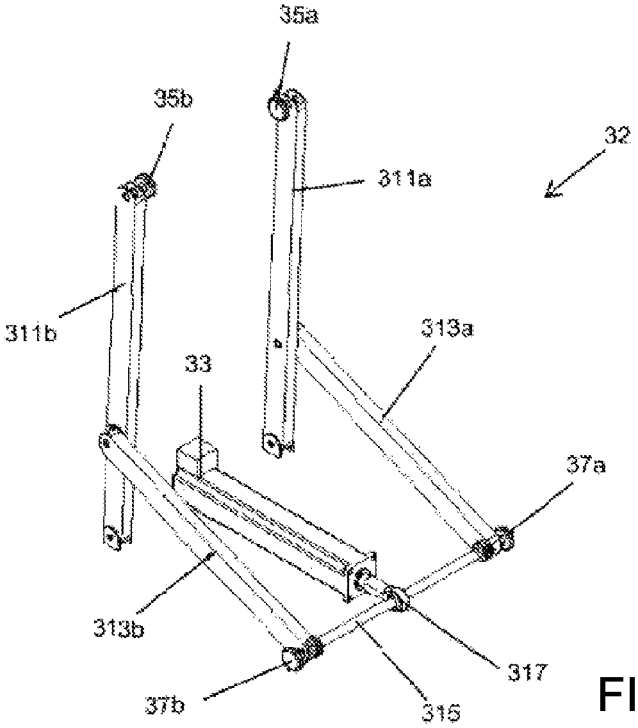

FIGS. 7A-7C depicts the support mechanisms and drive mechanisms of a second exemplary embodiment of the apparatus of the present invention. FIGS. 7A-7C are similar to FIGS. 5A-5C and the same reference numerals have been used in both figures to identify related or identical parts in the first and second embodiments. Thus, only the substantial differences between the first and second embodiments will be discussed.

As shown, the support mechanisms 31 and 32 of the second exemplary embodiment include platform bars 311*a*, 311*b*, 312*a*, and 312*b* and links 313*a*, 313*b*, 314*a*, and 314*b*. The cross-shafts 315 and 316, however, connect the ends of the links 313*a*:313*b* and 314*a*:314*b*. As depicted, the cross-shafts 315 and 316 connect the links 311*a*:311*b* and 312*a*:312*b* at approximately the same location that the base track rollers 37*a*, 37*b*, 38*a*, and 38*b* are connected. The cross-shafts 315 and 316 may be connected to the links 313*a*, 313*b*, 314*a*, and 314*b* at other locations in other embodiments to facilitate control over the motion of the platform 40 during operation.

The cross-shafts 315 and 316 provide a point of contact for the drive mechanisms 33 and 34. As previously discussed, the drive mechanisms 33 and 34 may be connected to their respective support mechanisms 31 and 32 at a variety of angles. For example, FIGS. 7A-C depicts drive mechanisms 33 and 34 at a substantially horizontal angle (i.e., with respect to the ground).

Figure 8:
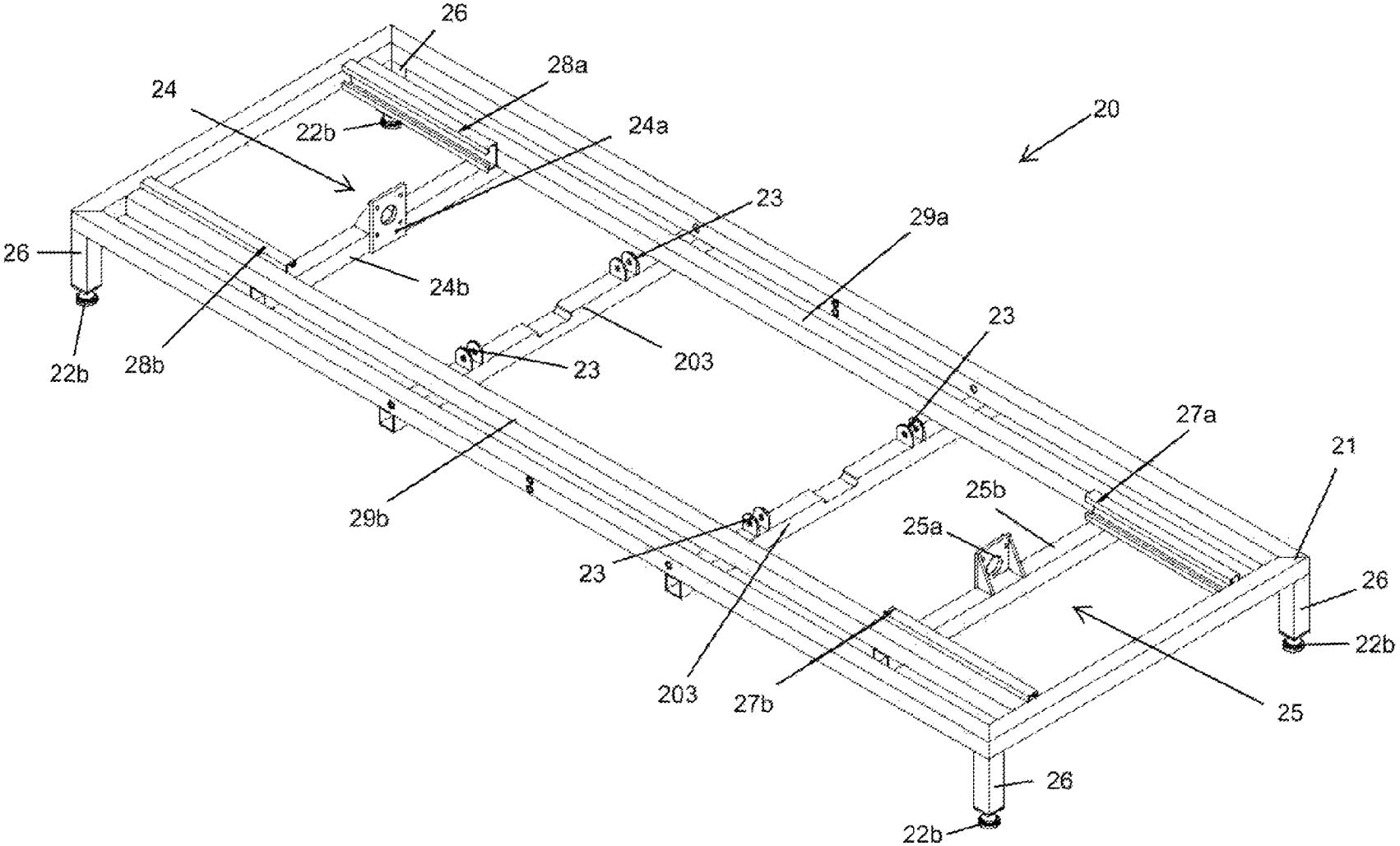
FIG. 8 is a perspective view of the base of the second exemplary embodiment of the apparatus of the present invention.

FIG. 8 depicts the base 20 of the second exemplary embodiment of the apparatus of the present invention. Again, FIG. 8 is similar to FIG. 6 and the same reference numerals have been used in both figures to identify related or identical parts in the first and second embodiments. Thus, only the substantial differences between the first and second embodiments will be discussed. For example, in FIG. 8, the base 20 includes stationary feet 22*b* instead of wheels. The feet 22, are illustrated at the corners, but may be attached to the base frame 21 at a variety of locations to provide adequate support.

The base 20 includes the capital drive mount 24 and the pedestal drive mount 25 on which the drive mechanisms 33 and 34 (See FIGS. 7A-7C) can be mounted. The drive mounts 24 and 25 are two-piece mounts that complement the angle of the drive mechanisms 33 and 34. In this regard, the pedestal drive mount 25 includes mount 25*a* and cross-brace 25*b*, and the capital drive mount 24 includes mount 24*a* and cross-brace 24*b*. The cross-braces 24*b* and 25*b* are attached to the base braces 29*a* and 29*b*. The drive mounts 24 and 25 are attached to the base 20 to provide appropriate support for the horizontal movement of the drive mechanisms 33 and 34.

In yet another aspect, the apparatus can be described as a platform for supporting an individual in a generally supine position. A capital pivot at the capital end of the platform rotates the capital end of the platform around a first axis of rotation defined by the capital pivot. A pedestal pivot at the pedestal end of the platform rotates the pedestal end of the platform around a second axis of rotation defined by the pedestal pivot. Means functionally connected to the capital pivot move the capital pivot and the first axis of rotation in at least two degrees of freedom. Similar means functionally connected to the pedestal pivot also move the pedestal pivot and the second axis of rotation in at least two degrees of freedom.

With respect to the drawings as already described, the platform is illustrated as platform 40 having a capital portion 40C, a pedestal portion 40P, and a surface 41. The respective capital pivot and pedestal pivot are illustrated generally by the upper ends of the platform bars 311*a*, 311*b*, 312*a*, and 312*b*. In a specific embodiment, the respective capital pivot and pedestal pivot may be the platform track rollers 35*a*, 35*b*, 36*a*, and 36*b*. The means for moving the capital pivot and the pedestal pivot have been illustrated and described as the support mechanisms 31 and 32 and the drive mechanisms 33 and 34. The means for moving the capital pivot and the pedestal pivot, however, may be a variety of devices and combinations of devices (e.g., motors, actuators, pistons, or pulley systems).

As used herein, the phrase "degree of freedom" is used in its engineering sense to describe directional motion in a three-dimensional space. For example, movement in one degree of freedom describes movement in a vertical direction, or alternatively, movement in a horizontal direction. Similarly, movement in two degrees of from describes movement in both a vertical direction and a horizontal direction (e.g., up and down as well as left and right). Movement in three degrees of freedom describes movement in a vertical direction and both horizontal directions (e.g., up and down, left and right, and forward and backward).

In some exemplary embodiments, the apparatus 10 may include a protective skirt (not shown) that precludes access to the space underneath the platform 40. For example, the protective skirt may be included in embodiments of the apparatus 10 that will be located in residential settings to prevent children or pets from entering the space underneath the platform 40. Additional safety features may be included in the apparatus 10 such as metal, rubber, or plastic housings to protect wiring and moving parts of the apparatus 10 and to prevent injury to the user or others during operation.

Typically, the dimensions of the apparatus 10 (e.g., the respective widths and lengths of the platform 40 and base 20) are such that the device may be shipped easily and moved within a typical residential home. In this regard, the apparatus 10 may have dimensions that are sufficient to fit through typical residential internal and external doorways. Furthermore, embodiments of the apparatus 10 that include wheels 22*a* (See e.g. FIGS. 4 and 6) are particularly well-suited for applications in which the apparatus 10 will need to be moved frequently.

In the specification and/or figures, typical embodiments of the invention have been disclosed. The present invention is not limited to such exemplary embodiments. Indeed embodiments including other components, such as the addition of soothing sound, aromatherapy, sound-canceling headsets, biofeedback sounds, guided meditation messages and the like are considered to be within the scope of this invention. The use of the term "and/or" includes any and all combinations of one or more of the associated listed items. Where numerical ranges are used, it should be understood that all numbers therebetween are also inherently disclosed. The figures are schematic representations and so are not necessarily drawn to scale. Unless otherwise noted, specific terms have been used in a generic and descriptive sense and not for purposes of limitation.

We claim:

1. A method of treating an individual, comprising the sequential steps of:

(a) positioning a patient on a platform having a capital portion and a pedestal portion, said capital portion and pedestal portion independently capable of raising and lower;

(b) raising the capital portion only;

(c) raising the capital portion and pedestal portion simultaneously until capital portion reaches height (T);

(d) raising the pedestal portion only until pedestal portion reaches height (T);

(e) lowering the capital portion only;

(f) lowering the capital portion and pedestal portion simultaneously until capital portion reaches height (B);

(g) lowering the pedestal portion only until pedestal portion reaches height (B); and (h) sequentially repeating steps b through g at least 2 times.

2. A method according to claim 1 wherein said step of raising the capital portion only tilts the platform at an angle between 5° and 15°.

3. A method according to claim 1 wherein said step of lowering the capital portion only tilts the platform at an angle between 5° and 15°.

4. A method of treating an individual by correlating body movement and breathing, comprising the sequential steps of:

(a) monitoring a patient to determine the inspiratory duration and the expiratory duration of their breathing cycle;

(b) positioning a patient on a platform having a capital portion and a pedestal portion, said capital portion and pedestal portion independently capable of raising and lower;

(c) raising the capital portion only;

(d) raising the capital portion and pedestal portion simultaneously until capital portion reaches height (T);

(e) raising the pedestal portion only until pedestal portion reaches height (T), wherein said raising steps are performed in a time period based on said inspiratory duration;

(f) lowering the capital portion only;

(g) lowering the capital portion and pedestal portion simultaneously until capital portion reaches height (B); and (h) lowering the pedestal portion only until pedestal portion reaches height (B), wherein said lowering steps are performed in a time period based on said expiratory duration.

5. A method according to claim 4 wherein said lowering steps are performed in a time period greater than said expiratory duration.

6. A method according to claim 4, wherein said lowering steps are performed in a time period less than said expiratory duration.

7. A method according to claim 4 further comprising the step of maintaining capital portion and pedestal portion at height (T) for approximately 2 seconds, said step performed immediately prior to step of lowering the capital portion only.

8. A method according to claim 4 further comprising the step of maintaining capital portion and pedestal portion at height (B) for approximately 4-6 seconds, said step performed immediately after step of lowering the pedestal portion only until pedestal portion reaches height (B).

9. A method according to claim 4, wherein the ratio between the time duration of performing the raising steps, and the time duration of performing the lowering steps, is about 1:2.

10. A method according to claim 4 further comprising the step of instructing the individual to inhale during the raising steps and instructing the individual to exhale during the lowering steps.

11. A method according to claim 4 further comprising the step of continuously monitoring the inspiratory duration and expiratory duration and adjusting the time duration of performing the raising steps based on inspiratory duration, and adjusting the time duration of performing the lowering steps based on expiratory duration.

12. A method of treating an individual, comprising the sequential steps of:

(a) selecting a patient having at least one clinical indicator selected from the group consisting of chronic obstructive pulmonary disease, apnea of prematurity, obstructive sleep apnea, post-surgical adhesions, post surgical DVT, pitting peripheral edema, inability to tolerate CPAP or BiPAP (NIPPV), difficulty with inhaled medications, and combinations thereof;

(b) positioning said patient on a platform having a capital portion and a pedestal portion, said capital portion and pedestal portion independently capable of raising and lower;

(c) raising the capital portion only;

(d) raising the capital portion and pedestal portion simultaneously until capital portion reaches height (T);

(e) raising the pedestal portion only until pedestal portion reaches height (T), wherein said raising steps are performed in a time period based on said inspiratory duration;

(f) lowering the capital portion only;

(g) lowering the capital portion and pedestal portion simultaneously until capital portion reaches height (B); and (h) lowering the pedestal portion only until pedestal portion reaches height (B), wherein said lowering steps are performed in a time period based on said expiratory duration.

13. A method according to claim 12 further comprising the step of determining respiratory rate prior to raising the capital portion.

14. A method according to claim 12 further comprising the step of monitoring respiratory rate during treatment.

15. A method according to claim 14 further comprising the step of terminating treatment based on respiratory rate.

16. A method according to claim 14 further comprising the step of immediately repeating steps (c) through (h) based on respiratory rate.

* * * * *